US010607530B2

(12) United States Patent
Yi et al.

(10) Patent No.: US 10,607,530 B2
(45) Date of Patent: Mar. 31, 2020

(54) POWER VOLTAGE GENERATING CIRCUIT AND DISPLAY APPARATUS INCLUDING THE SAME

(71) Applicant: Samsung Display Co., Ltd., Yongin-si, Gyeonggi-do (KR)

(72) Inventors: Shimho Yi, Seoul (KR); Sung-In Kang, Seoul (KR); Kyunho Kim, Hwaseong-si (KR); Seunghwan Moon, Asan-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 130 days.

(21) Appl. No.: 15/819,367

(22) Filed: Nov. 21, 2017

(65) Prior Publication Data

US 2018/0144680 A1 May 24, 2018

(30) Foreign Application Priority Data

Nov. 24, 2016 (KR) ..... 10-2016-0157564

(51) Int. Cl.

| | |
|---|---|
| ***G09G 3/30*** | (2006.01) |
| ***G09G 3/36*** | (2006.01) |
| ***G09G 3/20*** | (2006.01) |
| ***G05F 3/24*** | (2006.01) |
| ***G09G 3/00*** | (2006.01) |

(52) U.S. Cl.
CPC ..... *G09G 3/2092* (2013.01); *G05F 3/24* (2013.01); *G09G 3/006* (2013.01); *G09G 3/2096* (2013.01); *G09G 2300/0819* (2013.01); *G09G 2310/0291* (2013.01); *G09G 2310/08* (2013.01); *G09G 2330/04* (2013.01); *G09G 2330/12* (2013.01)

(58) Field of Classification Search
CPC ..... G09G 2330/00–2330/12
See application file for complete search history.

(56) References Cited

U.S. PATENT DOCUMENTS 8,976,101 B2 3/2015 Chang et al.
2017/0328953 A1* 11/2017 D'Angelo ..... H03K 7/08

FOREIGN PATENT DOCUMENTS

KR 101398121 B1 5/2014

* cited by examiner

*Primary Examiner* — Sanghyuk Park
(74) *Attorney, Agent, or Firm* — Cantor Colburn LLP

(57) ABSTRACT

A power voltage generating circuit includes an input part, a clock determining part and a plurality of switches. The input part receives a plurality of clock signals and generates a plurality of peak signals corresponding to rising edges of the plurality of clock signals. The clock determining part determines a normal mode and an abnormal mode based on a number of the plurality of peak signals. The switches blocks outputs of the plurality of clock signals in the abnormal mode.

20 Claims, 12 Drawing Sheets

POWER VOLTAGE GENERATING CIRCUIT AND DISPLAY APPARATUS INCLUDING THE SAME

This application claims priority to Korean Patent Application No. 10-2016-0157564, filed on Nov. 24, 2016, and all the benefits accruing therefrom under 35 U.S.C. § 119, the content of which in its entirety is herein incorporated by reference.

BACKGROUND

1. Field

Exemplary embodiments of the invention relate to a power voltage generating circuit and a display apparatus including the power voltage generating circuit. More particularly, exemplary embodiments of the invention relate to a power voltage generating circuit for protecting a gate driver by monitoring a plurality of clock signals and a display apparatus including the power voltage generating circuit.

2. Description of the Related Art

Generally, a display apparatus includes a display panel and a display panel driver. The display panel includes a plurality of gate lines, a plurality of data lines and a plurality of pixels. The display panel driver includes a gate driver providing gate signals to the plurality of gate lines, a data driver providing data voltages to the plurality of data lines, a timing controller controlling driving timings of the gate driver and the data driver and a power voltage generator generating signals to drive the display panel.

The power voltage generator may provide a clock signal to the gate driver. The clock signal may have an abnormal status due to open or short of a signal wiring.

SUMMARY

Conventionally, a clock signal is fed back from a gate driver and the clock signal is monitored using a single monitoring line. However, when a plurality of clock signals having different phases is used to drive a display panel and the single monitoring is used, an accuracy of the monitoring of the clock signal may be decreased. In addition, when a plurality of monitoring lines is used to monitor the plurality of the clock signals, an additional area may be desired in the gate driver or in the display panel on which the gate driver is mounted so that a bezel of the display apparatus may be increased.

Exemplary embodiments of the invention provide a power voltage generating circuit accurately monitoring a plurality of clock signals to protect a gate driver.

Exemplary embodiments of the invention also provide a display apparatus including the power voltage generating circuit.

In an exemplary embodiment of a power voltage generating circuit according to the invention, the power voltage generating circuit includes an input part, a clock determining part and a plurality of switches. The input part receives a plurality of clock signals and generates a plurality of peak signals corresponding to rising edges of the plurality of clock signals. The clock determining part determines a normal mode and an abnormal mode based on a number of the plurality of peak signals. The switches block outputs of the plurality of clock signals in the abnormal mode.

In an exemplary embodiment, the input part may include an input diode which receives a clock signal of the plurality of clock signals and an input capacitor connected to the input diode in series.

In an exemplary embodiment, the clock determining part may include a peak detecting part which detects the plurality of peak signals, a mode determining signal generating part which generates a mode determining signal in response to the plurality of peak signals and a comparing part which compares the mode determining signal and a mode reference voltage to generate a mode signal.

In an exemplary embodiment, the peak detecting part may include an operation amplifier including a first input terminal connected to the input capacitor, a second input terminal connected to a first power source and an output terminal. The peak detecting part may amplify the plurality of peak signals to generate a plurality of second peak signals.

In an exemplary embodiment, the mode determining signal generating part may generate the mode determining signal having a sawtooth wave in response to the plurality of second peak signals.

In an exemplary embodiment, the mode determining signal generating part may include a second power source, a signal generating resistor including a first end connected to the second power source and a second end connected to an output electrode of a signal generating transistor, a signal generating capacitor connected to the second end of the signal generating resistor and the signal generating transistor including a control electrode to which the plurality of second peak signals are applied, an input electrode connected to a ground and the output electrode connected to the second end of the signal generating resistor.

In an exemplary embodiment, the mode determining signal generating part may further include a second signal generating resistor including a first end connected to the signal generating transistor and a second end connected to the ground.

In an exemplary embodiment, the comparing part may include a third power source and a comparator including a first input terminal connected to the third power source, a second input terminal connected to the output electrode of the signal generating transistor and an output electrode connected to an output node of the clock determining part.

In an exemplary embodiment, the power voltage generating circuit may further include a shutdown control part which receives an output signal of the clock determining part and generates a switching control signal to control the switches.

In an exemplary embodiment, the shutdown control part may include a first resistor including a first end connected to a first node and a second end connected to a ground, a first diode including a first electrode connected to the first end of the first resistor and a second electrode connected to a second node, a second resistor including a first end connected to a power source and a second end connected to the second node, a third resistor including a first end connected to the second node and a second end connected to the ground, a first transistor including a control electrode connected to the second node, an input electrode connected to the ground and an output electrode connected to a third node, a fourth resistor including a first end connected to the power source and a second end connected to the third node, a fifth resistor including a first end connected to the third node and a second end connected to a fourth node, a first capacitor including a first end connected to the fourth node and a second end connected to the ground, a shutdown operation amplifier including a first input terminal connected to the fourth node, a second input terminal to which a shutdown reference voltage is applied and an output terminal, a sixth resistor including a first end connected to the second input terminal of the shutdown operation amplifier and a second end connected to the ground and a seventh resistor including a first end connected to the output terminal of the shutdown operation amplifier and a second end connected to the second input terminal of the shutdown operation amplifier.

In an exemplary embodiment, the number of the plurality of clock signals may be N. The clock signals may have phases different from each other. Each of the plurality of clock signals may be periodically repeated. Distances between the rising edges of the plurality of clock signals may be uniform in a first cycle in the normal mode. Each of the distances between the rising edges of first to N-th clock signals in the first cycle may be substantially the same as the distance between the rising edge of the N-th clock signal in the first cycle and a rising edge of a first clock signal in a second cycle in the normal mode. N is a natural number equal to or greater than two.

In an exemplary embodiment, the number of the plurality of clock signals may be N. The plurality of clock signals may have phases different from each other. Each of the plurality of clock signals may be periodically repeated. Distances between the rising edges of the plurality of clock signals may be uniform in a first cycle in the normal mode. Each of the distances between the rising edges of first to N-th clock signals in the first cycle is different from the distance between the rising edge of the N-th clock signal in the first cycle and a rising edge of a first clock signal in a second cycle in the normal mode. N is a natural number equal to or greater than two.

In an exemplary embodiment of a display apparatus according to the invention, the display apparatus includes a display panel, a gate driver, a data driver, a timing controller and a power voltage generator. The display panel displays an image. The gate driver provides a gate signal to the display panel. The data driver provides a data voltage to the display panel. The timing controller controls driving timing of the gate driver and driving timing of the data driver. The power voltage generator provides a plurality of clock signals to the gate driver. The power voltage generator includes an input part which receives the plurality of clock signals and generates a plurality of peak signals corresponding to rising edges of the plurality of clock signals, a clock determining part which determines a normal mode and an abnormal mode based on the number of the plurality of peak signals and a plurality of switches blocking outputs of the plurality of clock signals in the abnormal mode.

In an exemplary embodiment, the input part may include an input diode which receives a clock signal of the plurality of clock signals and an input capacitor connected to the input diode in series.

In an exemplary embodiment, the clock determining part may include a peak detecting part which detects the plurality of peak signals, a mode determining signal generating part which generates a mode determining signal in response to the plurality of peak signals and a comparing part which compares the mode determining signal and a mode reference voltage to generate a mode signal.

In an exemplary embodiment, the peak detecting part may include an operation amplifier including a first input terminal connected to the input capacitor, a second input terminal connected to a first power source and an output terminal. The peak detecting part may amplify the plurality of peak signals to generate a plurality of second peak signals.

In an exemplary embodiment, the mode determining signal generating part may include a second power source, a signal generating resistor including a first end connected to the second power source and a second end connected to an output electrode of a signal generating transistor, a signal generating capacitor connected to the second end of the signal generating resistor and the signal generating transistor including a control electrode to which the plurality of second peak signals are applied, an input electrode connected to a ground and the output electrode connected to the second end of the signal generating resistor.

In an exemplary embodiment, the comparing part may include a third power source and a comparator including a first input terminal connected to the third power source, a second input terminal connected to the output electrode of the signal generating transistor and an output electrode connected to an output node of the clock determining part.

In an exemplary embodiment, the display apparatus may further include a printed circuit board ("PCB") on which the power voltage generator and the timing controller may be disposed. The input part of the power voltage generator may be disposed on the PCB. The clock determining part and the switches may be formed as a single chip.

In an exemplary embodiment, the input part of the power voltage generator, the clock determining part and the switches may be formed as a single chip.

According to the power voltage generating circuit and the display apparatus including the power voltage generating circuit, peaks of the plural clock signals are detected, the abnormal operation of the display apparatus is determined according to the number of the peaks of the rising edges, and output of the clock signal may be stopped when the display apparatus is in the abnormal operation. Thus, the clock signals may be accurately monitored so that the gate driver may be protected. Therefore, the reliability of the display apparatus may be improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
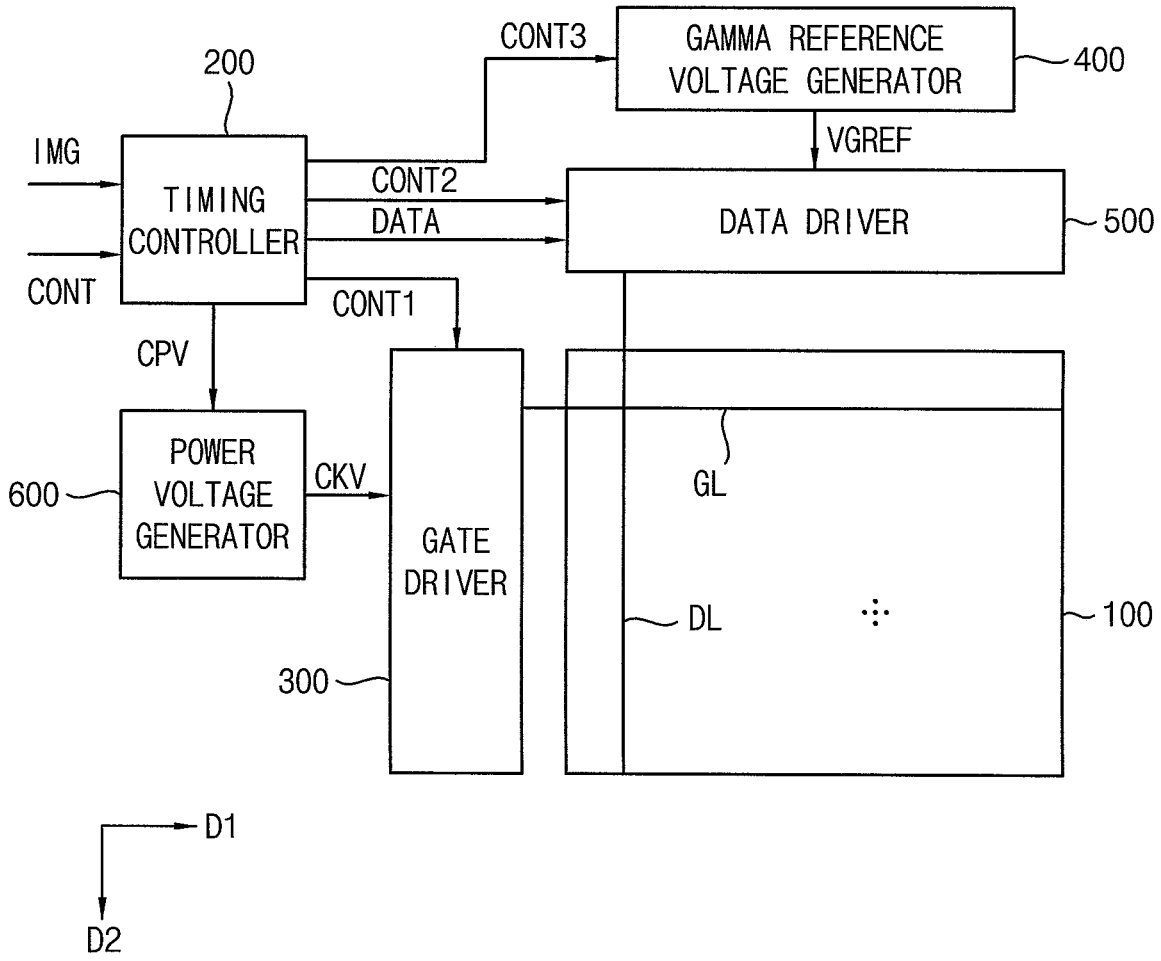
FIG. 1 is a block diagram illustrating an exemplary embodiment of a display apparatus according to the invention.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to an exemplary embodiment of the invention.

Referring to FIG. 1, the display apparatus includes a display panel 100 and a display panel driver. The display panel driver includes a timing controller 200, a gate driver 300, a gamma reference voltage generator 400, a data driver 500 and a power voltage generator 600.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

Each pixel may include a switching element (not shown), a liquid crystal capacitor (not shown) and a storage capacitor (not shown). The liquid crystal capacitor and the storage capacitor may be electrically connected to the switching element. The pixels may be disposed in a matrix form.

The timing controller 200 receives input image data IMG and an input control signal CONT from an external apparatus (not shown). In an exemplary embodiment, the input image data IMG may include red image data, green image data and blue image data, for example. However, the invention is not limited thereto, and the input image data IMG may include various other color data. In an exemplary embodiment, the input control signal CONT may include a master clock signal and a data enable signal, for example. In an exemplary embodiment, the input control signal CONT may further include a vertical synchronizing signal and a horizontal synchronizing signal, for example.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. In an exemplary embodiment, the first control signal CONT1 may include a vertical start signal, for example.

The timing controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may generate an initial clock signal CPV and outputs the initial clock signal CPV to the power voltage generator 600.

The gate driver 300 generates gate signals driving the gate lines GL in response to the first control signal CONT1 received from the timing controller 200. The gate driver 300 outputs the gate signals to the gate lines GL. In an exemplary embodiment, the gate driver 300 may sequentially output the gate signals to the gate lines GL, for example.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500, for example. However, the invention is not limited thereto, and the gamma reference voltage generator 400 may be disposed in various other elements.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate a signal and a direct current ("DC") voltage for driving the display apparatus.

In an exemplary embodiment, the power voltage generator 600 may generate a common voltage of the display panel 100, for example. The power voltage generator 600 may generate a power voltage of the gate driver 300. The power voltage generator 600 may generate a power voltage of the gamma reference voltage generator 400. The power voltage generator 600 may generate a power voltage of the data driver 500.

The power voltage generator 600 generates a clock signal CKV of the gate driver 300 based on the initial clock signal CPV. The power voltage generator 600 outputs the clock signal CKV to the gate driver 300.

The operation of the power voltage generator 600 is further explained referring to FIGS. 3 to 6 in detail.

Figure 2:
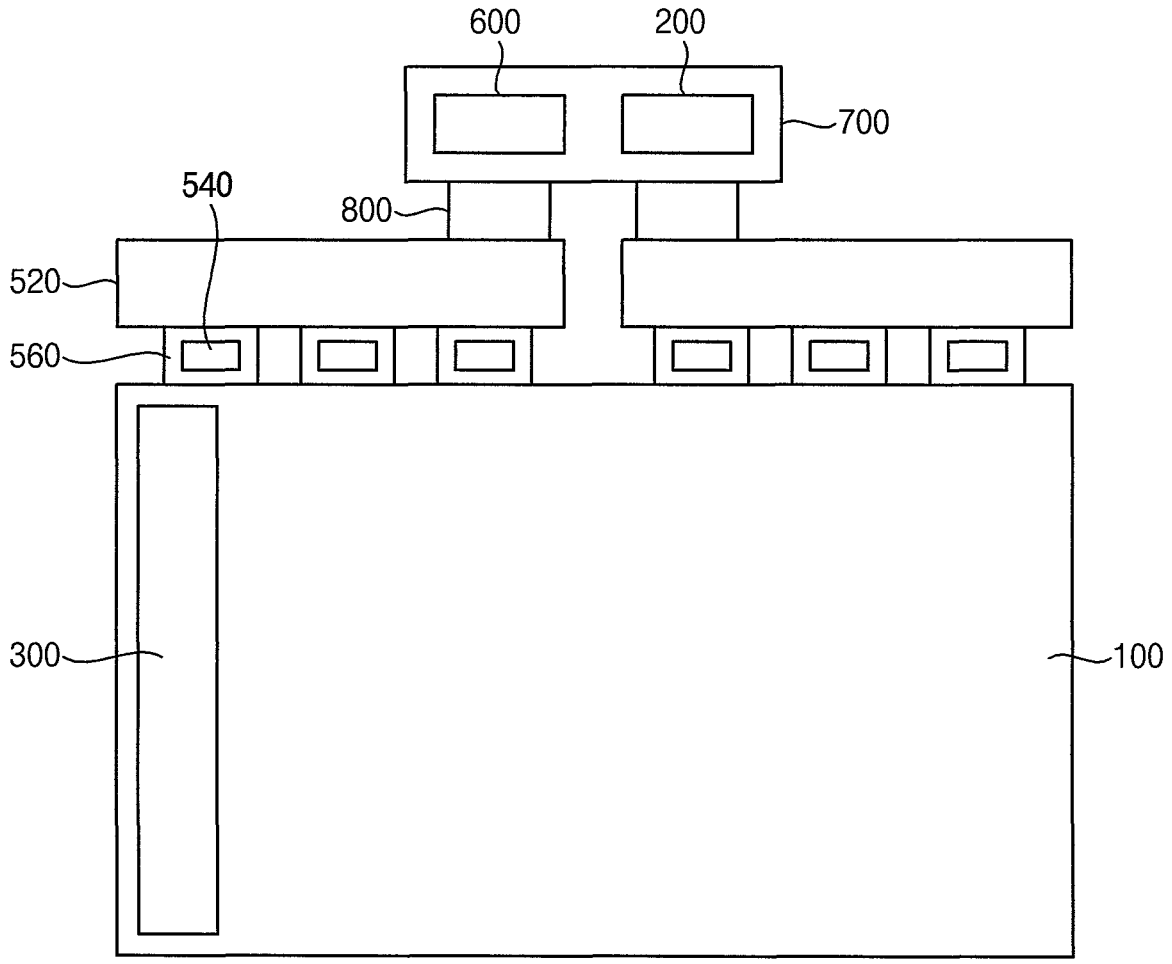
FIG. 2 is a plan view illustrating the display apparatus of FIG. 1.

FIG. 2 is a plan view illustrating the display apparatus of FIG. 1.

Referring to FIGS. 1 and 2, the gate driver 300 may be disposed (e.g., integrated) on the display panel 100. In an alternative exemplary embodiment, the gate driver 300 may be mounted on the display panel 100.

The display apparatus may further include a main printed circuit board ("PCB") 700 on which the timing controller 200 and the power voltage generator 600 are disposed (e.g., mounted).

The data driver 500 may include a plurality of data driving chips 540. The data driving chips 540 may be disposed (e.g., mounted) on the data connecting circuit board 560. The data driving chips 540 may be connected to each other through a sub PCB 520. The data connecting circuit board 560 connects the sub PCB 520 to the display panel 100.

The display apparatus may further include a main connecting circuit board 800 connecting the main PCB 700 to the sub PCB 520.

Figure 3:
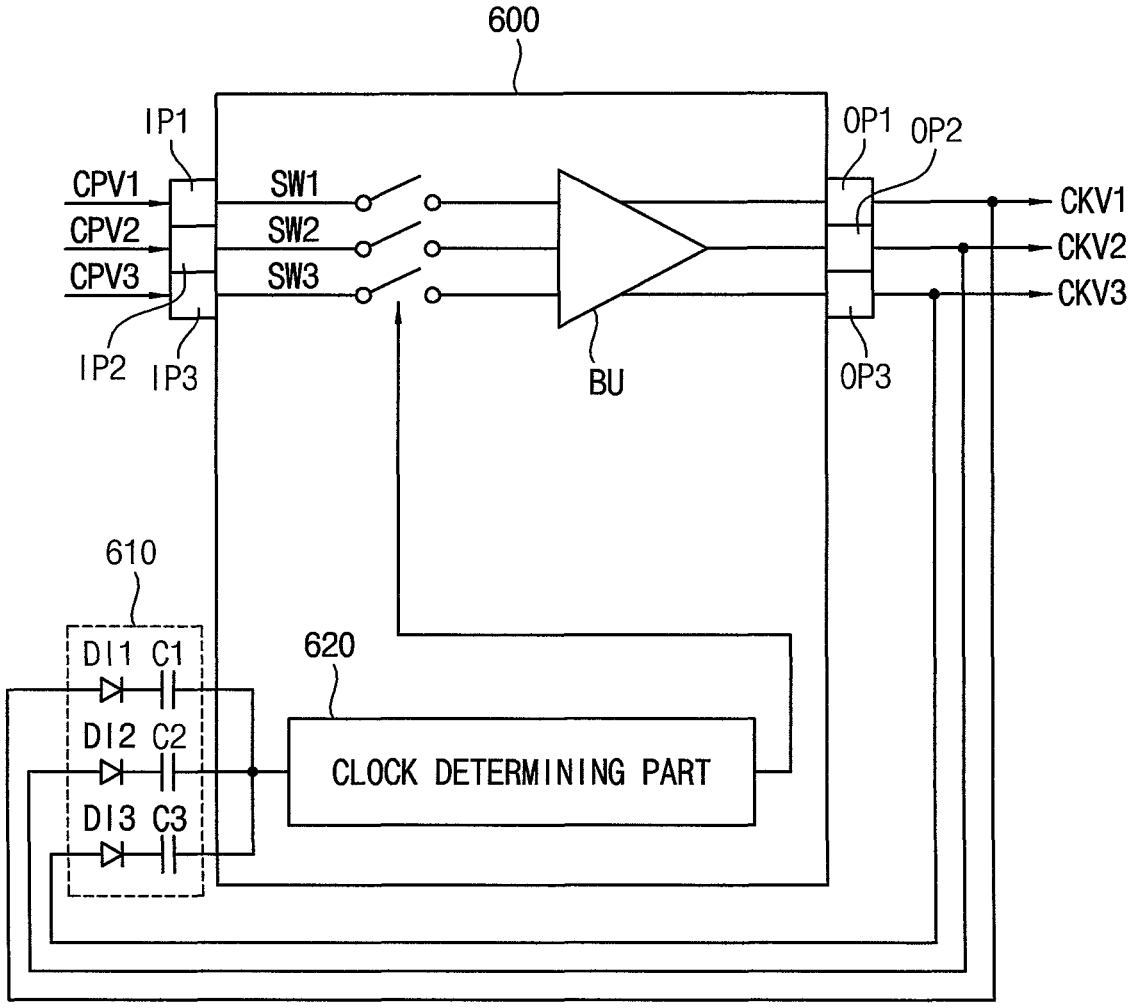
FIG. 3 is a circuit diagram illustrating a power voltage generator of FIG. 1.
Figure 4:
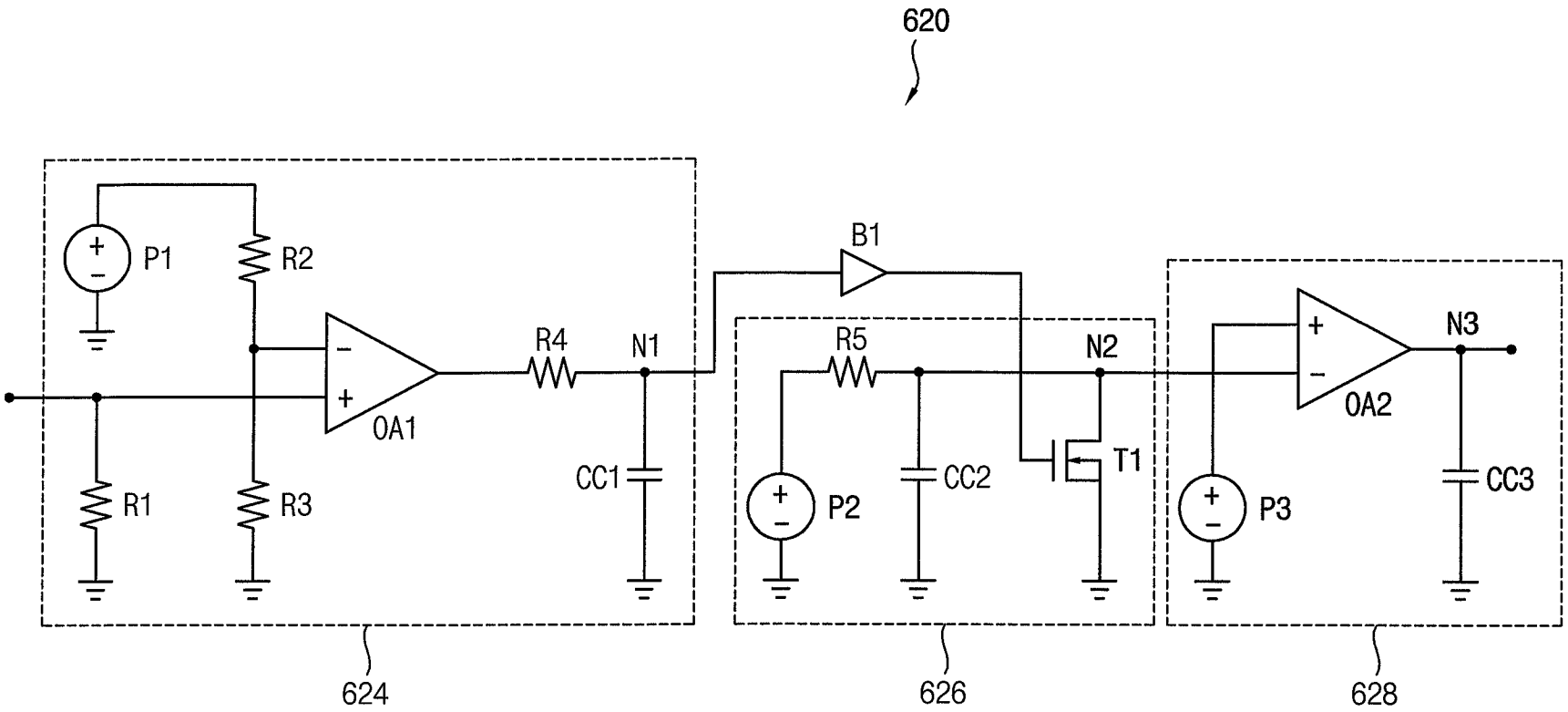
FIG. 4 is a circuit diagram illustrating a clock determining part of FIG. 3.

FIG. 3 is a circuit diagram illustrating the power voltage generator 600 of FIG. 1. FIG. 4 is a circuit diagram illustrating a clock determining part 620 of FIG. 3.

Referring to FIGS. 1 to 4, the power voltage generator 600 includes an input part 610, the clock determining part 620 and a plurality of switches SW1, SW2 and SW3.

The power voltage generator 600 receives a plurality of the initial clock signals CPV1, CPV2 and CPV3 from the timing controller 200. The power voltage generator 600 generates the clock signals CKV1, CKV2 and CKV3 based on the initial clock signals CPV1, CPV2 and CPV3.

The initial clock signals CPV1, CPV2 and CPV3 may be respectively inputted in the power voltage generator 600 through input pads IP1, IP2 and IP3.

In an exemplary embodiment, the clock signals CKV1, CKV2 and CKV3 may respectively have waveforms similar to waveforms of the initial clock signals CPV1, CPV2 and CPV3, for example. In an exemplary embodiment, the clock signals CKV1, CKV2 and CKV3 may respectively have phases same as phases of the initial clock signals CPV1, CPV2 and CPV3, for example. In an exemplary embodiment, the clock signals CKV1, CKV2 and CKV3 may respectively have levels different from levels of the initial clock signals CPV1, CPV2 and CPV3, for example. In an exemplary embodiment, the clock signals CKV1, CKV2 and CKV3 may respectively have the levels greater than the levels of the initial clock signals CPV1, CPV2 and CPV3, for example.

The plural clock signals CKV1, CKV2 and CKV3 may have phases different from one another. Each of the plural clock signals CKV1, CKV2 and CKV3 may be periodically repeated.

The power voltage generator 600 outputs the clock signals CKV1, CKV2 and CKV3 to the gate driver 300.

The clock signals CKV1, CKV2 and CKV3 may be respectively outputted to the gate driver 300 through output pads OP1, OP2 and OP3.

In FIGS. 3 to 6, for example, the power voltage generator 600 outputs the three clock signals having the phases different from one another. However, the invention is not limited thereto. In an alternative exemplary embodiment, the power voltage generator 600 may output two clock signals having the phases different from each other.

The clock signals CKV1, CKV2 and CKV3 outputted to the gate driver 300 are applied to the input part 610 of the power voltage generator 600.

The input part 610 receives the plural clock signals CKV1, CKV2 and CKV3 and generates peak signals corresponding to rising edges of the clock signals CKV1, CKV2 and CKV3.

The input part 610 may include an input diode DI1, DI2 and DI3 and an input capacitor C1, C2 and C3 respectively connected to the input diode DI1, DI2 and DI3 in series.

In an exemplary embodiment, the input part 610 may include a first input diode DI1 to which the first clock signal CKV1 is applied and a first input capacitor C1 connected to the first input diode DI1 in series, for example.

In an exemplary embodiment, the input part 610 may include a second input diode DI2 to which the second clock signal CKV2 having a phase different from a phase of the first clock signal CKV1 is applied and a second input capacitor C2 connected to the second input diode DI2 in series, for example.

In an exemplary embodiment, the input part 610 may include a third input diode DI3 to which the third clock signal CKV3 having a phase different from the phase of the first clock signal CKV1 and the phase of the second clock signal CKV2 is applied and a third input capacitor C3 connected to the third input diode DI3 in series, for example.

Only a peak component of the rising edge of the first clock signal CKV1 may be inputted to the clock determining part 620 by the first input diode DI1 and the first input capacitor C1.

Only a peak component of the rising edge of the second clock signal CKV2 may be inputted to the clock determining part 620 by the second input diode DI2 and the second input capacitor C2.

Only a peak component of the rising edge of the third clock signal CKV3 may be inputted to the clock determining part 620 by the third input diode DI3 and the third input capacitor C3.

The clock determining part 620 may determine a normal mode and an abnormal mode based on the number of the peak signals.

The clock determining part 620 may include a peak detecting part 624 detecting the peak signal, a mode determining signal generating part 626 generating a mode determining signal in response to the peak signals and a comparing part 628 comparing the mode determining signal and a mode reference voltage to generate a mode signal.

The peak detecting part 624 may include an operation amplifier OA1 including a first input terminal connected to the input capacitor C1, C2 and C3, a second input terminal connected to a first power source P1 and an output terminal.

In an exemplary embodiment, the peak detecting part 624 may further include the first power source P1, a first resistor R1 connected between the first input terminal of the operation amplifier OA1 and a ground, a second resistor R2 connected between the first power source P1 and the second input terminal of the operation amplifier OA1, a third resistor R3 connected between the second input terminal of the operation amplifier OA1 and the ground and a fourth resistor R4 connected between the output terminal of the operation amplifier OA1 and a first node N1 and a first capacitor CC1 connected between the first node N1 and the ground, for example.

The peak detecting part 624 may amplify the peak signals corresponding to the rising edges of the clock signals to generate second peak signals. The peak signals may be applied to the first input terminal of the operation amplifier OA1. The second peak signals may be outputted from the first node N1.

The second peak signals at the first node N1 may be applied to the mode determining signal generating part 626 through a first buffer B1.

The mode determining signal generating part 626 generates the mode determining signal in response to the second peak signals. In an exemplary embodiment, the mode determining signal generating part 626 may generate the mode determining signal having a sawtooth wave in response to the second peak signals, for example.

In an exemplary embodiment, the mode determining signal generating part 626 may include a second power source P2, a fifth resistor R5 including a first end connected to the second power source P2 and a second end connected to an output electrode of a first transistor T1, a second capacitor CC2 connected to the second end of the fifth resistor R5 and the first transistor T1 including a control electrode to which the second peak signals are applied, an input electrode connected to the ground and the output electrode connected to the second end of the fifth resistor R5, for example.

In an exemplary embodiment, the first transistor T1 may be a signal generating transistor, the fifth resistor R5 may be a signal generating resistor and the second capacitor CC2 may be a signal generating capacitor. According to a time constant of a resistor-capacitor ("RC") circuit formed by the fifth resistor R5 and the second capacitor CC2, the wave form of the mode determining signal outputted to the output electrode of the first transistor T1 may be determined.

The comparing part 628 compares the mode determining signal and the mode reference voltage to generate the mode signal. The mode signal may be one of a normal mode signal representing a normal operation of the power voltage generator 600 and an abnormal mode signal representing an abnormal operation of the power voltage generator 600.

In an exemplary embodiment, when a level of the mode signal is a high level, the power voltage generator 600 is in the normal operation, for example. In an exemplary embodiment, when a level of the mode signal is a low level, the power voltage generator 600 is in the abnormal operation, for example.

In an exemplary embodiment, the normal operation of the power voltage generator 600 means that the levels of the clock signals CKV1, CKV2 and CKV3 which are outputted to the gate driver 300 from the power voltage generator 600 are in normal states, for example. Thus, the normal operation of the power voltage generator 600 may mean a normal operation of the gate driver 300.

In an exemplary embodiment, the abnormal operation of the power voltage generator 600 means that the levels of the clock signals CKV1, CKV2 and CKV3 which are outputted to the gate driver 300 from the power voltage generator 600 are in abnormal states, for example. Thus, the abnormal operation of the power voltage generator 600 may mean an abnormal operation of the gate driver 300.

In an exemplary embodiment, when at least one of the clock signals CKV1, CKV2 and CKV3 is not normally outputted to the gate driver 300, the power voltage generator is determined as in the abnormal operation, for example. When some of the clock lines of the clock signals CKV1, CKV2 and CKV3 are shorted with each other, an amplitude of the rising edge of the clock signals CKV1, CKV2 and CKV3 may be reduced so that some of the peak signals of the clock signals may not be detected. As a result, when some of the clock lines of the clock signals CKV1, CKV2 and CKV3 are shorted with each other, the mode of the power voltage generator 600 may be determined as the abnormal mode. In an alternative exemplary embodiment, due to various reasons, the clock signals CKV1, CKV2 and CKV3 may not be normally outputted to the gate driver 300. When the clock signals CKV1, CKV2 and CKV3 are not normally outputted to the gate driver 300, the clock determining part 620 may determine the mode of the power voltage generator as the abnormal mode.

In an exemplary embodiment, the comparing part 628 may include a third power source P3, an comparator OA2 including a first input terminal connected to the third power source P3, a second input terminal connected to the output electrode of the signal generating transistor T1 of the mode determining signal generating part 626 and an output terminal connected to an output node N3 of the clock determining part 620, for example.

The comparing part 628 may further include a third capacitor CC3 connected between the output node N3 of the clock determining part 620 and the ground.

The power voltage generator 600 may further include a signal converting part BU disposed between the input pad IP1, IP2 and IP3 and the output pad OP1, OP2 and OP3.

The power voltage generator 600 may further include a plurality of switches SW1, SW2 and SW3 disposed between the input pads IP1, IP2 and IP3 and the signal converting part BU.

When the comparing part 628 determines that the power voltage generator 600 is in the abnormal mode, the switches SW1, SW2 and SW3 are turned off so that the output of the clock signals CKV1, CKV2 and CKV3 of the power voltage generator 600 is blocked.

When the comparing part 628 determines that the power voltage generator 600 is in the normal mode, the switches SW1, SW2 and SW3 are turned on so that the clock signals CKV1, CKV2 and CKV3 are outputted to the gate driver 300.

Figure 5:
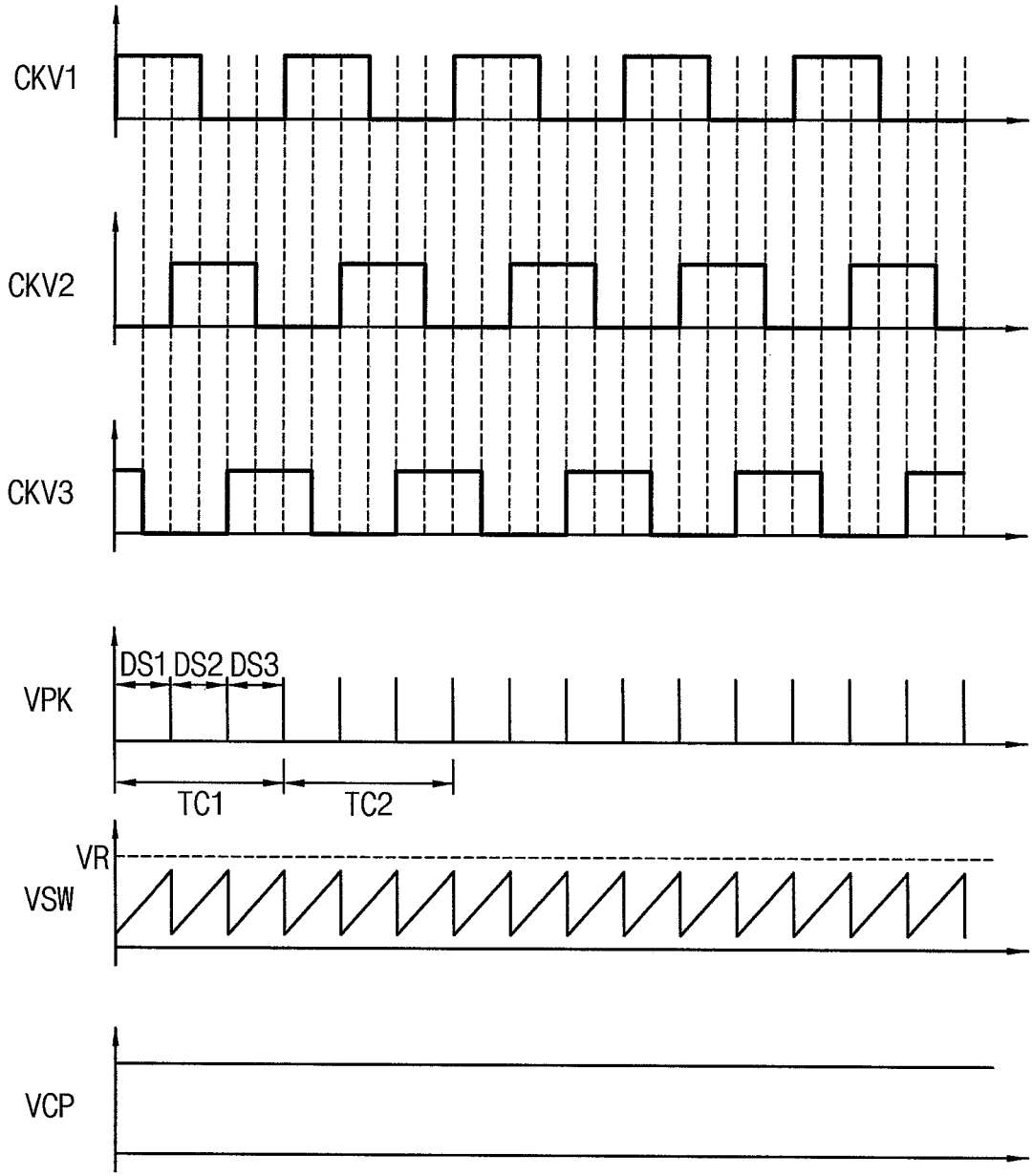
FIG. 5 is a timing diagram illustrating input signals and output signals of the clock determining part of FIG. 3 in a normal mode.
Figure 6:
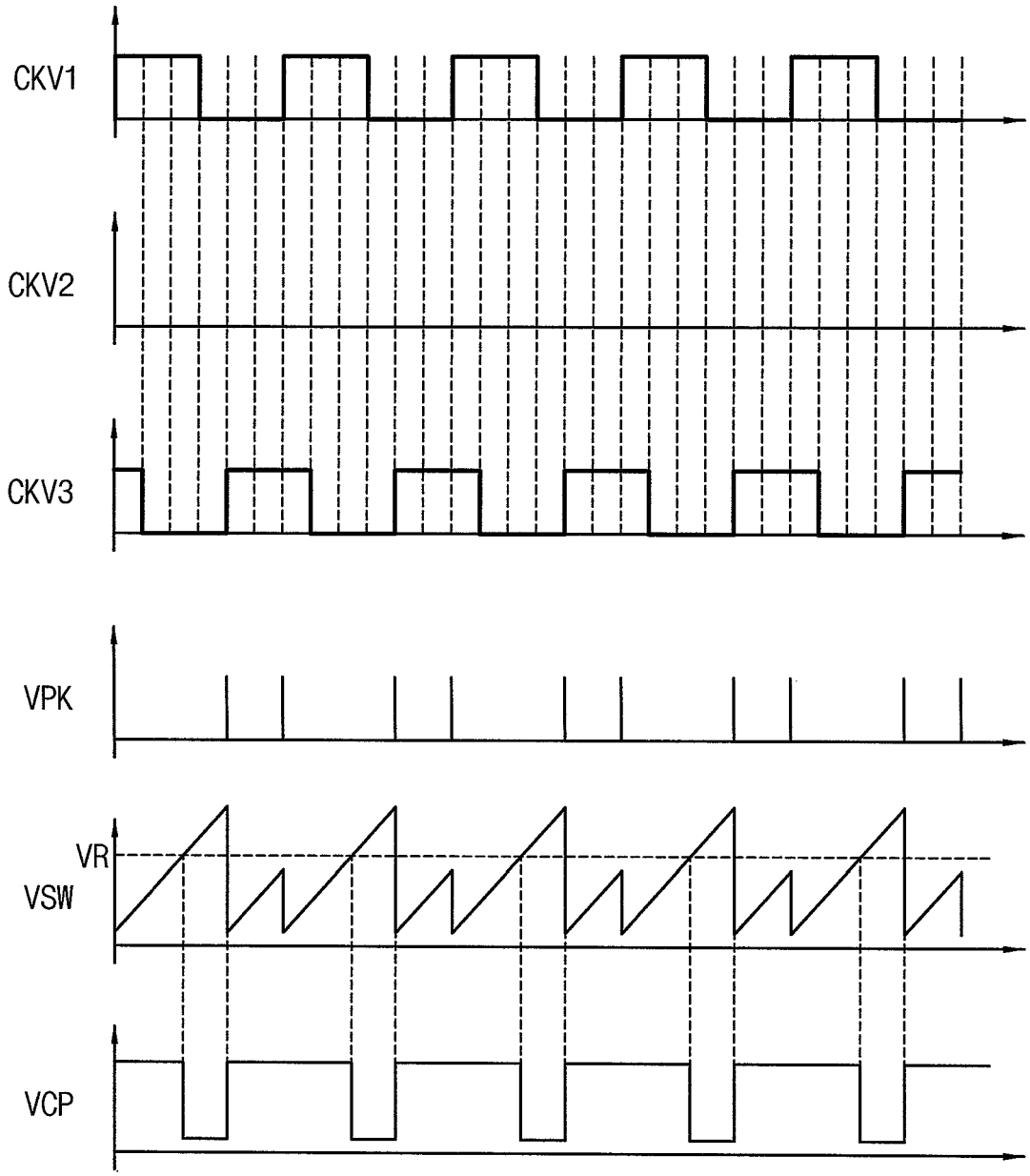
FIG. 6 is a timing diagram illustrating input signals and output signals of the clock determining part of FIG. 3 in an abnormal mode.

FIG. 5 is a timing diagram illustrating input signals and output signals of the clock determining part 620 of FIG. 3 in a normal mode. FIG. 6 is a timing diagram illustrating input signals and output signals of the clock determining part 620 of FIG. 3 in an abnormal mode.

Referring to FIGS. 1 to 6, the clock signals CKV1, CKV2 and CKV3 may have phases different from one another. Each of the clock signals CKV1, CKV2 and CKV3 may be periodically repeated.

In the normal mode, distances DS1 and DS2 between the rising edges of the first to N-th clock signals are uniform in a first cycle TC1 where N is a natural number equal to or greater than two. In an exemplary embodiment, the first cycle TC1 is defined as a time duration between a first rising edge and a second rising edge of the first clock signal CKV1, for example. As shown in FIG. 5, a distance DS1 between a peak of the first clock signal CKV1 and a peak of the second clock signal CKV2 is substantially the same as a distance DS2 between the peak of the second clock signal CKV2 and a peak of the third clock signal CKV3 in the first cycle TC1.

In addition, a distance DS3 between the peak of the third clock signal CKV3 in the first cycle TC1 and a peak of the first clock signal CKV1 in a second cycle TC2 is substantially the same as the distance DS2 between the peak of the second clock signal CKV2 and the peak of the third clock signal CKV3 in the first cycle TC1.

The peak signal of the rising edge of the first clock signal CKV1 is applied to the peak detecting part 624 through the first input diode DI1 and the first input capacitor CC1 of the input part 610.

The peak signal of the rising edge of the second clock signal CKV2 is applied to the peak detecting part 624 through the second input diode DI2 and the second input capacitor CC2 of the input part 610.

The peak signal of the rising edge of the third clock signal CKV3 is applied to the peak detecting part 624 through the third input diode DI3 and the third input capacitor CC3 of the input part 610.

The peak signals of the first to third clock signals CKV1, CKV2 and CKV3 are amplified to the second peak signals by the operation amplifier OA1 of the peak detecting part 624. The second peak signals are applied to the first node N1. In FIG. 5, the second peak signals VPK at the first node N1 are illustrated.

The mode determining signal generating part 626 generates the mode determining signal VSW having an increasing waveform at the second node N2 using the signal generating resistor R5 and the signal generating capacitor CC2. When the second peak signal VPK is applied to the control electrode of the signal generating transistor T1, the signal generating transistor T1 is turned on and the level of the mode determining signal VSW is decreased to the ground level in a moment. In this process, the mode determining signal generating part 626 generates the mode determining signal VSW having a sawtooth wave in response to the second peak signals.

In the normal mode of FIG. 5, the second peak signals VPK corresponding to the peaks of the rising edges of the first to third clock signals CKV1, CKV2 and CKV3 decreases the level of the mode determining signal VSW such that the level of the mode determining signal VSW does not exceed the mode reference voltage VR.

In FIG. 5, the level of the mode determining signal VSW does not exceed the mode reference voltage VR so that the mode signal VCP generated by the comparing part 628 only has a high level. The high level of the mode signal VCP means the normal operation of the power voltage generator 600.

FIG. 6 illustrates the abnormal operation in which the second clock signal CKV2 of the first to third clock signals CKV1, CKV2 and CKV3 is not applied, for example.

In the abnormal mode of FIG. 6, the second peak signals VPK corresponding to the peaks of the rising edges of the first to third clock signals CKV1, CKV2 and CKV3 is not able to decrease the level of the mode determining signal VSW such that the level of the mode determining signal VSW does not exceed the mode reference voltage VR. The second peak signals VPK corresponding to the peaks of the rising edges of the first clock signal CKV1 and the third clock signal CKV3 decreases the level of the mode determining signal VSW. However, the second peak signals VPK is not generated corresponding to the rising edge of the second clock signal CKV2 so that the mode determining signal VSW exceeds the mode reference voltage VR.

In FIG. 6, the comparing part 628 generates the mode signal VCP having the low level corresponding to the time duration when the level of the mode determining signal VSW exceeds the mode reference voltage VR. The high level of the mode signal VCP means the normal operation of the power voltage generator 600. The low level of the mode signal VCP means the abnormal operation of the power voltage generator 600. When the mode signal VCP has the low level, the operation of the power voltage generator 600 is stopped.

In the illustrated exemplary embodiment, the output signal VCP of the comparing part 628 may be directly applied to the switches SW1, SW2 and SW3.

In the illustrated exemplary embodiment, the input diode DI1, DI2 and DI3 and the input capacitor C1, C2 and C3 of the input part 610 of the power voltage generator 600 may be formed on the main PCB 700. The elements (e.g., the clock determining part 620, the switches SW1, SW2 and SW3 and the signal converting part BU) of the power voltage generator 600 except for the input part 610 may be formed as a single chip, for example.

According to the illustrated exemplary embodiment, the peaks of the rising edges of the clock signals CKV1, CKV2 and CKV3 are detected, the abnormal operation of the display apparatus is determined according to the number of the peaks of the rising edges, and the output of the clock signals CKV1, CKV2 and CKV3 may be stopped. Thus, the clock signals CKV1, CKV2 and CKV3 may be efficiently monitored and the gate driver 300 may be protected. Therefore, the reliability of the display apparatus may be improved.

Figure 7:
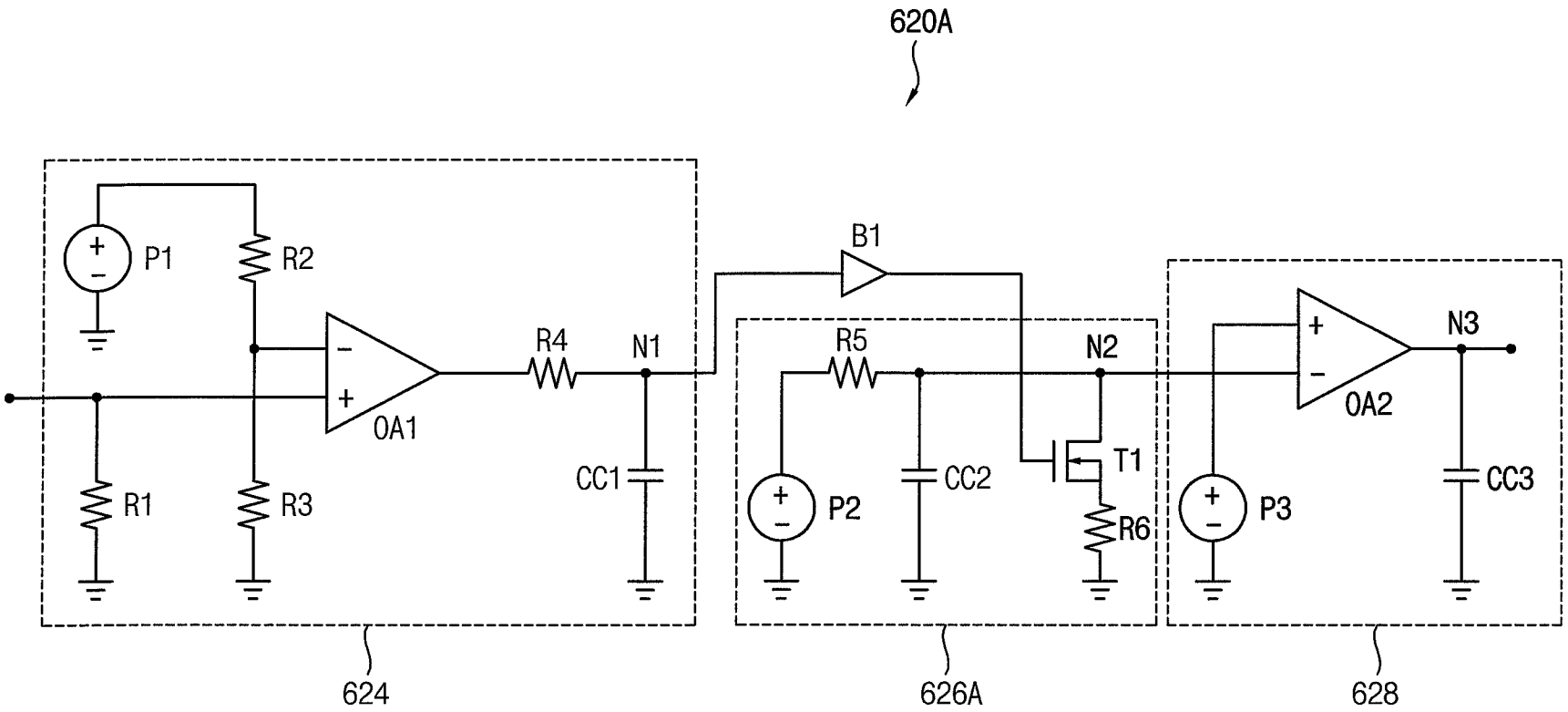
FIG. 7 is a circuit diagram illustrating an exemplary embodiment of a clock determining part of a power voltage generator according to the invention.
Figure 8:
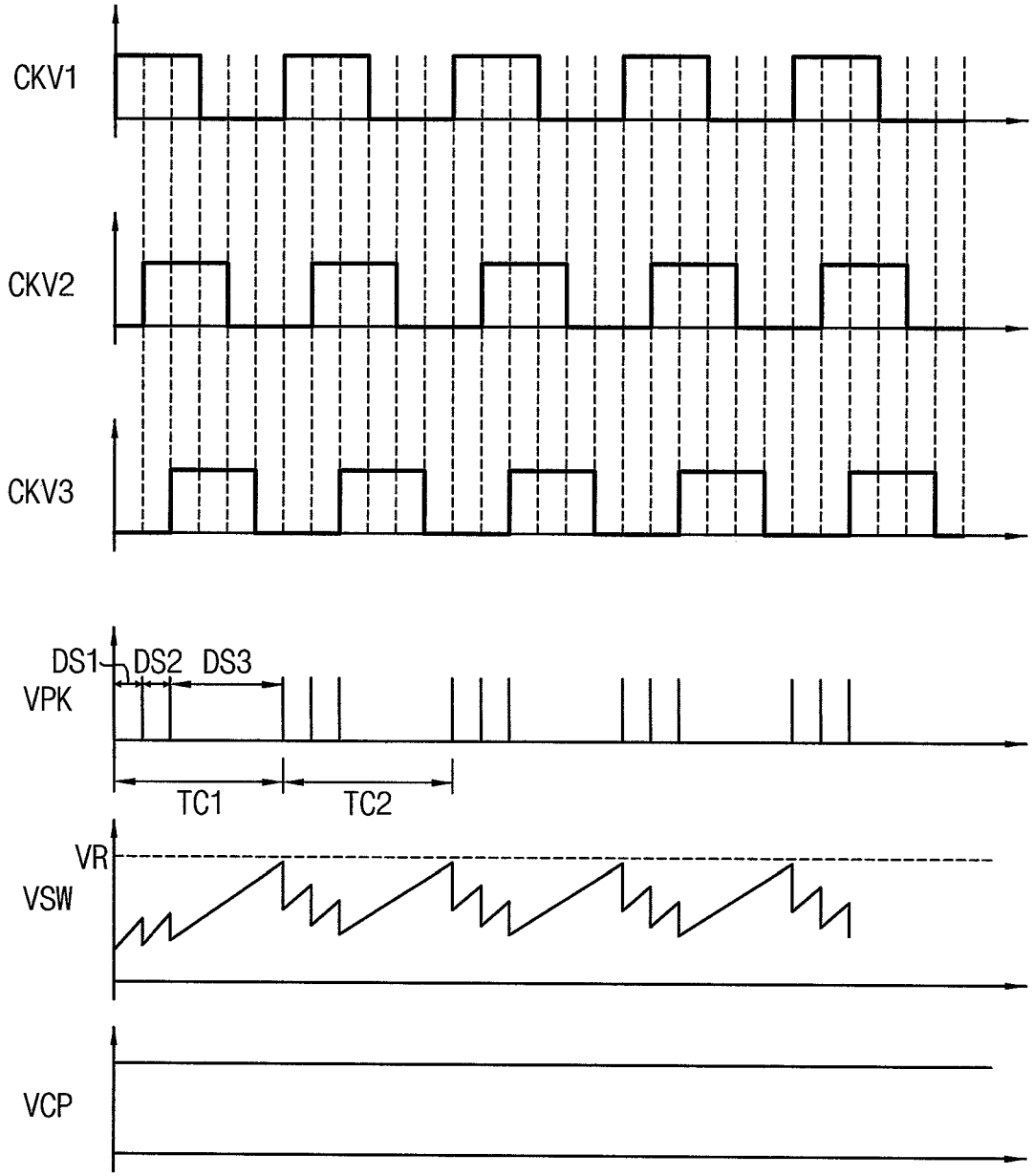
FIG. 8 is a timing diagram illustrating input signals and output signals of the clock determining part of FIG. 7 in a normal mode.
Figure 9:
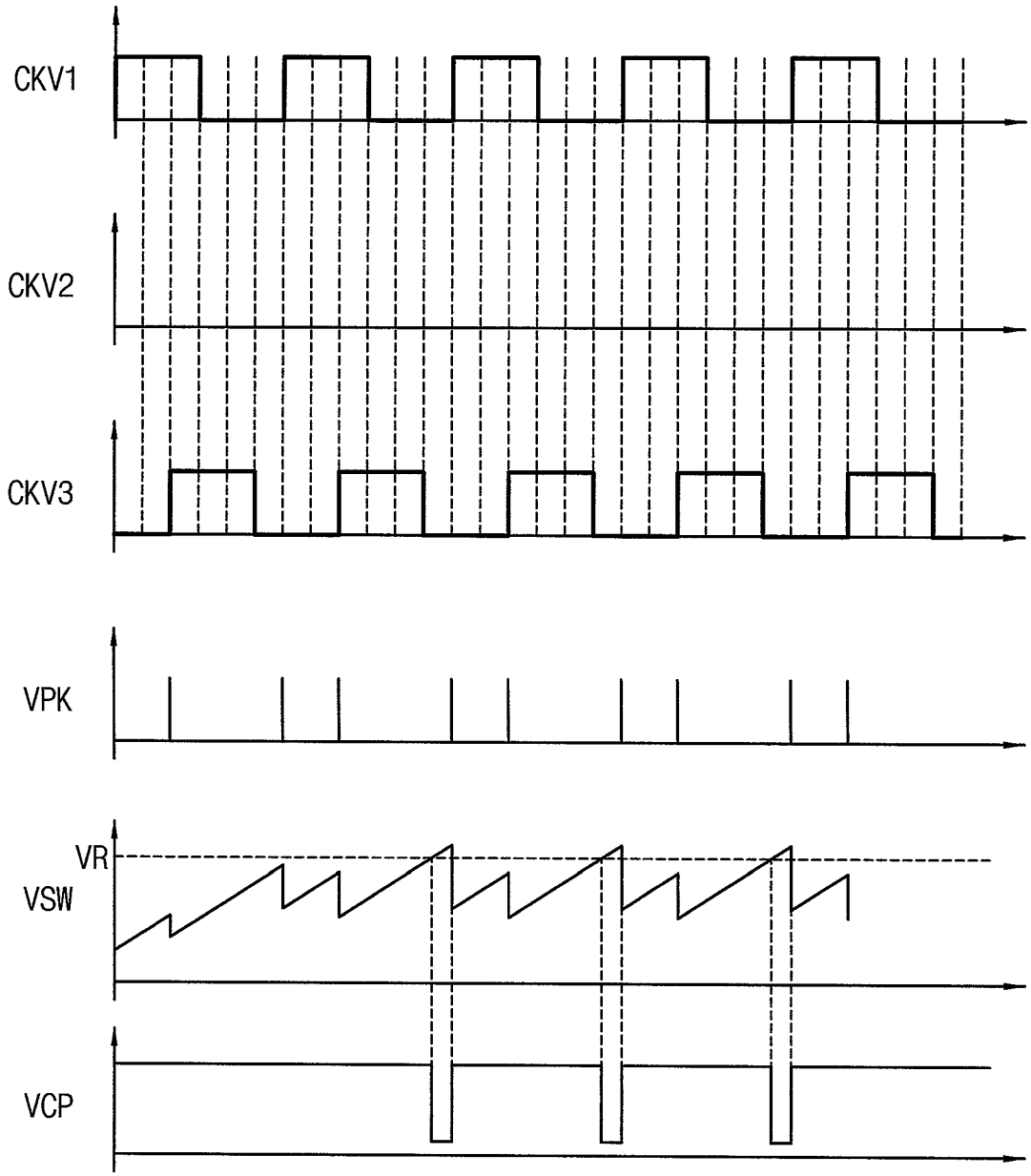
FIG. 9 is a timing diagram illustrating input signals and output signals of the clock determining part of FIG. 7 in an abnormal mode.

FIG. 7 is a circuit diagram illustrating a clock determining part of a power voltage generator according to an exemplary embodiment of the invention. FIG. 8 is a timing diagram illustrating input signals and output signals of the clock determining part of FIG. 7 in a normal mode. FIG. 9 is a timing diagram illustrating input signals and output signals of the clock determining part of FIG. 7 in an abnormal mode.

The display apparatus according to the illustrated exemplary embodiment is substantially the same as the display apparatus of the previous exemplary embodiment explained referring to FIGS. 1 to 6 except for the circuit structure of the clock determining part and the phases of the clock signals. Thus, the same reference numerals will be used to refer to the same or like parts as those described in the previous exemplary embodiment of FIGS. 1 to 6 and any repetitive explanation concerning the above elements will be omitted.

Referring to FIGS. 1, 2 and 7 to 9, the display apparatus includes a display panel 100 and a display panel driver. The display panel driver includes a timing controller 200, a gate driver 300, a gamma reference voltage generator 400, a data driver 500 and a power voltage generator 600.

The timing controller 200 generates the first control signal CONT1 for controlling an operation of the gate driver 300 based on the input control signal CONT, and outputs the first control signal CONT1 to the gate driver 300. In an exemplary embodiment, the first control signal CONT1 may include a vertical start signal, for example.

The timing controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may generate an initial clock signal CPV and outputs the initial clock signal CPV to the power voltage generator 600.

The gate driver 300 generates gate signals driving the gate lines GL in response to the first control signal CONT1 received from the timing controller 200. The gate driver 300 outputs the gate signals to the gate lines GL. In an exemplary embodiment, the gate driver 300 may sequentially output the gate signals to the gate lines GL, for example.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate a signal and a DC voltage for driving the display apparatus.

In an exemplary embodiment, the power voltage generator 600 may generate a common voltage of the display panel 100, for example. The power voltage generator 600 may generate a power voltage of the gate driver 300. The power voltage generator 600 may generate a power voltage of the gamma reference voltage generator 400. The power voltage generator 600 may generate a power voltage of the data driver 500.

The power voltage generator 600 generates a clock signal CKV of the gate driver 300 based on the initial clock signal CPV. The power voltage generator 600 outputs the clock signal CKV to the gate driver 300.

The power voltage generator 600 includes an input part 610, the clock determining part 620A and a plurality of switches SW1, SW2 and SW3.

The power voltage generator 600 receives a plurality of the initial clock signals CPV1, CPV2 and CPV3 from the timing controller 200. The power voltage generator 600 generates the clock signals CKV1, CKV2 and CKV3 based on the initial clock signals CPV1, CPV2 and CPV3.

The initial clock signals CPV1, CPV2 and CPV3 may be respectively inputted in the power voltage generator 600 through input pads IP1, IP2 and IP3.

In an exemplary embodiment, the clock signals CKV1, CKV2 and CKV3 may respectively have waveforms similar to waveforms of the initial clock signals CPV1, CPV2 and CPV3, for example. In an exemplary embodiment, the clock signals CKV1, CKV2 and CKV3 may respectively have phases same as phases of the initial clock signals CPV1, CPV2 and CPV3, for example. In an exemplary embodiment, the clock signals CKV1, CKV2 and CKV3 may respectively have levels different from levels of the initial clock signals CPV1, CPV2 and CPV3, for example. In an exemplary embodiment, the clock signals CKV1, CKV2 and CKV3 may respectively have the levels greater than the levels of the initial clock signals CPV1, CPV2 and CPV3, for example.

The plural clock signals CKV1, CKV2 and CKV3 may have phases different from one another. Each of the plural clock signals CKV1, CKV2 and CKV3 may be periodically repeated.

The power voltage generator 600 outputs the clock signals CKV1, CKV2 and CKV3 to the gate driver 300.

The clock signals CKV1, CKV2 and CKV3 may be respectively outputted to the gate driver 300 through output pads OP1, OP2 and OP3.

In FIGS. 7 to 9, for example, the power voltage generator 600 outputs the three clock signals having the phases different from one another. However, the invention is not limited thereto. In an alternative exemplary embodiment, the power voltage generator 600 may output two clock signals having the phases different from each other, for example.

The clock signals CKV1, CKV2 and CKV3 outputted to the gate driver 300 are applied to the input part 610 of the power voltage generator 600.

The input part 610 receives the plural clock signals CKV1, CKV2 and CKV3 and generates peak signals corresponding to rising edges of the clock signals CKV1, CKV2 and CKV3.

The input part 610 may include an input diode DI1, DI2 and DI3 and an input capacitor C1, C2 and C3 respectively connected to the input diode DI1, DI2 and DI3 in series.

The clock determining part 620A may determine a normal mode and an abnormal mode based on the number of the peak signals.

The clock determining part 620A may include a peak detecting part 624 detecting the peak signal, a mode determining signal generating part 626A generating a mode determining signal in response to the peak signals and a comparing part 628 comparing the mode determining signal and a mode reference voltage to generate a mode signal.

The peak detecting part 624 may include an operation amplifier OA1 including a first input terminal connected to the input capacitor C1, C2 and C3, a second input terminal connected to a first power source P1 and an output terminal.

The peak detecting part 624 may amplify the peak signals corresponding to the rising edges of the clock signals to generate second peak signals. The peak signals may be applied to the first input terminal of the operation amplifier OA1. The second peak signals may be outputted from a first node N1.

The second peak signals at the first node N1 may be applied to the mode determining signal generating part 626A through a first buffer B1.

The mode determining signal generating part 626A generates the mode determining signal in response to the second peak signals. In an exemplary embodiment, the mode determining signal generating part 626A may generate the mode determining signal having a sawtooth wave in response to the second peak signals, for example.

In an exemplary embodiment, the mode determining signal generating part 626A may include a second power source P2, a fifth resistor R5 including a first end connected to the second power source P2 and a second end connected to an output electrode of a first transistor T1, a second capacitor CC2 connected to the second end of the fifth resistor R5 and the first transistor T1 including a control electrode to which the second peak signals are applied, an input electrode connected to a sixth resistor R6 and the output electrode connected to the second end of the fifth resistor R5, for example.

In an exemplary embodiment, the first transistor T1 may be a signal generating transistor, the fifth resistor R5 may be a signal generating resistor and the second capacitor CC2 may be a signal generating capacitor, for example. According to a time constant of an RC circuit formed by the fifth resistor R5 and the second capacitor CC2, the wave form of the mode determining signal outputted to the output electrode of the first transistor T1 may be determined.

In the illustrated exemplary embodiment, the second signal generating resistor R6 includes a first end connected to the signal generating transistor T1 and a second end connected to the ground.

Although the second peak signal VPK is applied to the control electrode of the signal generating transistor T1, a quantity of decrease of the level of the mode determining signal VSW is decreased by the second signal generating resistor R6.

The comparing part 628 compares the mode determining signal VSW and the mode reference voltage VR to generate the mode signal VCP. The mode signal VCP may be one of a normal mode signal representing a normal operation of the power voltage generator 600 and an abnormal mode signal representing an abnormal operation of the power voltage generator 600.

In an exemplary embodiment, when a level of the mode signal VCP is a high level, the power voltage generator 600 is in the normal operation, for example. In an exemplary embodiment, when a level of the mode signal VCP is a low level, the power voltage generator 600 is in the abnormal operation, for example.

In an exemplary embodiment, the comparing part 628 may include a third power source P3, an comparator OA2 including a first input terminal connected to the third power source P3, a second input terminal connected to the output electrode of the signal generating transistor T1 of the mode determining signal generating part 626A and an output terminal connected to an output node N3 of the clock determining part 620A, for example.

The comparing part 628 may further include a third capacitor CC3 connected between the output node N3 of the clock determining part 620A and the ground.

The power voltage generator 600 may further include a signal converting part BU disposed between the input pad IP1, IP2 and IP3 and the output pad OP1, OP2 and OP3.

The power voltage generator 600 may further include a plurality of switches SW1, SW2 and SW3 disposed between the input pads IP1, IP2 and IP3 and the signal converting part BU.

When the comparing part 628 determines that the power voltage generator 600 is in the abnormal mode, the switches SW1, SW2 and SW3 are turned off so that the output of the clock signals CKV1, CKV2 and CKV3 of the power voltage generator 600 is blocked.

When the comparing part 628 determines that the power voltage generator 600 is in the normal mode, the switches SW1, SW2 and SW3 are turned on so that the clock signals CKV1, CKV2 and CKV3 are outputted to the gate driver 300.

In the illustrated exemplary embodiment, the clock signals CKV1, CKV2 and CKV3 may have phases different from one another. Each of the clock signals CKV1, CKV2 and CKV3 may be periodically repeated.

In the normal mode, distances DS1 and DS2 between the rising edges of the first to N-th clock signals are uniform in a first cycle TC1. In an exemplary embodiment, the first cycle TC1 is defined as a time duration between a first rising edge and a second rising edge of the first clock signal CKV1, for example. As shown in FIG. 8, a distance DS1 between a peak of the first clock signal CKV1 and a peak of the second clock signal CKV2 is substantially the same as a distance DS2 between the peak of the second clock signal CKV2 and a peak of the third clock signal CKV3 in the first cycle TC1.

However, a distance DS3 between the peak of the third clock signal CKV3 in the first cycle TC1 and a peak of the first clock signal CKV1 in a second cycle TC2 is different from the distance DS2 between the peak of the second clock signal CKV2 and the peak of the third clock signal CKV3 in the first cycle TC1.

The peak signal of the rising edge of the first clock signal CKV1 is applied to the peak detecting part 624 through the first input diode DI1 and the first input capacitor CC1 of the input part 610.

The peak signal of the rising edge of the second clock signal CKV2 is applied to the peak detecting part 624 through the second input diode DI2 and the second input capacitor CC2 of the input part 610.

The peak signal of the rising edge of the third clock signal CKV3 is applied to the peak detecting part 624 through the third input diode DI3 and the third input capacitor CC3 of the input part 610.

The peak signals of the first to third clock signals CKV1, CKV2 and CKV3 are amplified to the second peak signals by the operation amplifier OA1 of the peak detecting part 624. The second peak signals are applied to the first node N1. In FIG. 8, the second peak signals VPK at the first node N1 are illustrated.

The mode determining signal generating part 626A generates the mode determining signal VSW having an increasing waveform at the second node N2 using the signal generating resistor R5 and the signal generating capacitor CC2. When the second peak signal VPK is applied to the control electrode of the signal generating transistor T1, the signal generating transistor T1 is turned on and the level of the mode determining signal VSW is decreased. Although the signal generating transistor T1 is turned on, the level of the mode determining signal VSW is not decreased to the ground level in a moment. In this process, the mode determining signal generating part 626A generates the mode determining signal VSW having a sawtooth wave in response to the second peak signals.

In the normal mode of FIG. 8, the second peak signals VPK corresponding to the peaks of the rising edges of the first to third clock signals CKV1, CKV2 and CKV3 decreases the level of the mode determining signal VSW such that the level of the mode determining signal VSW does not exceed the mode reference voltage VR.

In FIG. 8, the level of the mode determining signal VSW does not exceed the mode reference voltage VR so that the mode signal VCP generated by the comparing part 628 only has a high level. The high level of the mode signal VCP means the normal operation of the power voltage generator 600.

FIG. 9 illustrates the abnormal operation in which the second clock signal CKV2 of the first to third clock signals CKV1, CKV2 and CKV3 is not applied, for example.

In the abnormal mode of FIG. 9, the second peak signals VPK corresponding to the peaks of the rising edges of the first to third clock signals CKV1, CKV2 and CKV3 is not able to decrease the level of the mode determining signal VSW such that the level of the mode determining signal VSW does not exceed the mode reference voltage VR. The second peak signals VPK corresponding to the peaks of the rising edges of the first clock signal CKV1 and the third clock signal CKV3 decreases the level of the mode determining signal VSW. However, the second peak signals VPK is not generated corresponding to the rising edge of the second clock signal CKV2 so that the mode determining signal VSW exceeds the mode reference voltage VR.

In FIG. 9, the comparing part 628 generates the mode signal VCP having the low level corresponding to the time duration when the level of the mode determining signal VSW exceeds the mode reference voltage VR. The high level of the mode signal VCP means the normal operation of the power voltage generator 600. The low level of the mode signal VCP means the abnormal operation of the power voltage generator 600. When the mode signal VCP has the low level, the operation of the power voltage generator 600 is stopped.

In the illustrated exemplary embodiment, the differences of the phases of the first to third clock signals CKV1, CKV2 and CKV3 are not uniform. As explained above, although the differences of the phases of the first to third clock signals CKV1, CKV2 and CKV3 are not uniform, the operation of the power voltage generator 600 may be stopped when the number of the peak signals of the rising edges in the cycle of the clock signals is less than a reference number of the peak signals by adjusting the resistance of the signal generating resistor R5, the capacitance of the signal generating capacitor CC2 and the resistance of the second signal generating resistor R6.

In the illustrated exemplary embodiment, the output signal VCP of the comparing part 628 may be directly applied to the switches SW1, SW2 and SW3.

In the illustrated exemplary embodiment, the input diode DI1, DI2 and DI3 and the input capacitor C1, C2 and C3 of the input part 610 of the power voltage generator 600 may be formed on the main PCB 700. The elements (e.g. the clock determining part 620A, the switches SW1, SW2 and SW3 and the signal converting part BU) of the power voltage generator 600 except for the input part 610 may be formed as a single chip, for example.

According to the illustrated exemplary embodiment, the peaks of the rising edges of the clock signals CKV1, CKV2 and CKV3 are detected, the abnormal operation of the display apparatus is determined according to the number of the peaks of the rising edges, and the output of the clock signals CKV1, CKV2 and CKV3 may be stopped. Thus, the clock signals CKV1, CKV2 and CKV3 may be efficiently monitored and the gate driver 300 may be protected. Therefore, the reliability of the display apparatus may be improved.

Figure 10:
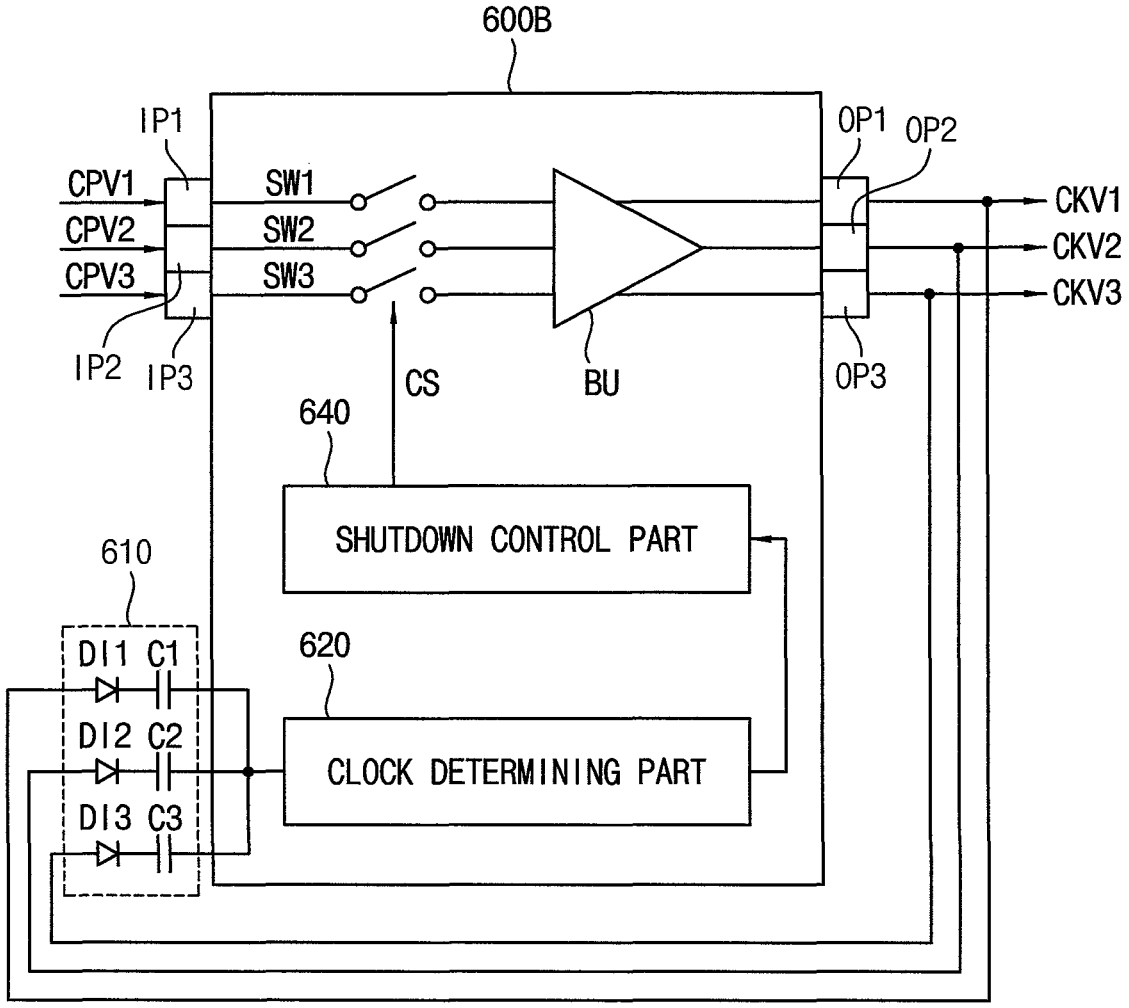
FIG. 10 is a circuit diagram illustrating an exemplary embodiment of a power voltage generator according to the invention.
Figure 11:
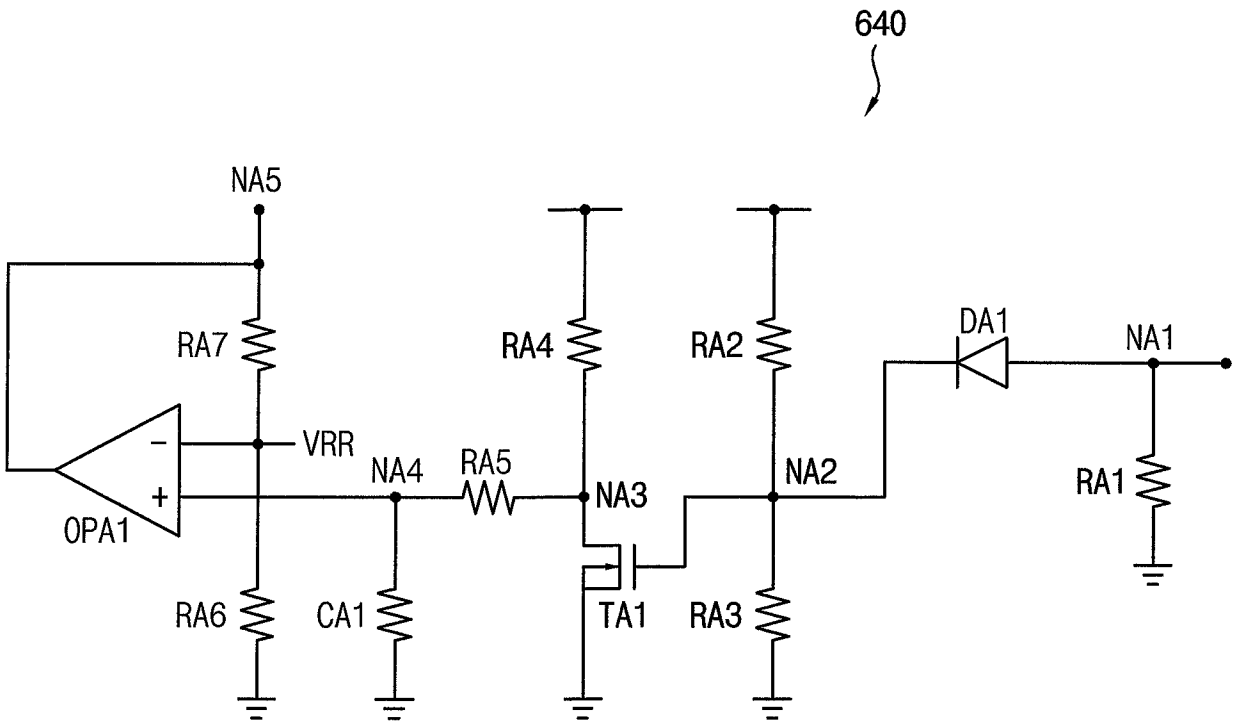
FIG. 11 is a circuit diagram illustrating a shutdown control part of FIG. 10.

FIG. 10 is a circuit diagram illustrating a power voltage generator 600B according to an exemplary embodiment of the invention. FIG. 11 is a circuit diagram illustrating a shutdown control part 640 of FIG. 10.

The display apparatus according to the illustrated exemplary embodiment is substantially the same as the display apparatus of the previous exemplary embodiment explained referring to FIGS. 1 to 6 except for the circuit structure of the power voltage generator. Thus, the same reference numerals will be used to refer to the same or like parts as those described in the previous exemplary embodiment of FIGS. 1 to 6 and any repetitive explanation concerning the above elements will be omitted.

Referring to FIGS. 1, 2, 4, 5, 10 and 11, the display apparatus includes a display panel 100 and a display panel driver. The display panel driver includes a timing controller 200, a gate driver 300, a gamma reference voltage generator 400, a data driver 500 and a power voltage generator 600B.

The timing controller 200 generates the first control signal CONT1 for controlling an operation of the gate driver 300 based on the input control signal CONT, and outputs the first control signal CONT1 to the gate driver 300. In an exemplary embodiment, the first control signal CONT1 may include a vertical start signal, for example.

The timing controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may generate an initial clock signal CPV and outputs the initial clock signal CPV to the power voltage generator 600B.

The gate driver 300 generates gate signals driving the gate lines GL in response to the first control signal CONT1 received from the timing controller 200. The gate driver 300 outputs the gate signals to the gate lines GL. In an exemplary embodiment, the gate driver 300 may sequentially output the gate signals to the gate lines GL, for example.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600B may generate a signal and a DC voltage for driving the display apparatus.

In an exemplary embodiment, the power voltage generator 600B may generate a common voltage of the display panel 100, for example. The power voltage generator 600B may generate a power voltage of the gate driver 300. The power voltage generator 600B may generate a power voltage of the gamma reference voltage generator 400. The power voltage generator 600B may generate a power voltage of the data driver 500.

The power voltage generator 600B generates a clock signal CKV of the gate driver 300 based on the initial clock signal CPV. The power voltage generator 600B outputs the clock signal CKV to the gate driver 300.

The power voltage generator 600B includes an input part 610, the clock determining part 620, a shutdown control part 640 and a plurality of switches SW1, SW2 and SW3.

The power voltage generator 600B receives a plurality of the initial clock signals CPV1, CPV2 and CPV3 from the timing controller 200. The power voltage generator 600B generates the clock signals CKV1, CKV2 and CKV3 based on the initial clock signals CPV1, CPV2 and CPV3.

The initial clock signals CPV1, CPV2 and CPV3 may be respectively inputted in the power voltage generator 600B through input pads IP1, IP2 and IP3.

The power voltage generator 600B outputs the clock signals CKV1, CKV2 and CKV3 to the gate driver 300.

The clock signals CKV1, CKV2 and CKV3 may be respectively outputted to the gate driver 300 through output pads OP1, OP2 and OP3.

The clock signals CKV1, CKV2 and CKV3 outputted to the gate driver 300 are applied to the input part 610 of the power voltage generator 600B.

The input part 610 receives the plural clock signals CKV1, CKV2 and CKV3 and generates peak signals corresponding to rising edges of the clock signals CKV1, CKV2 and CKV3.

The input part 610 may include an input diode DI1, DI2 and DI3 and an input capacitor C1, C2 and C3 connected to the input diode DI1, DI2 and DI3 in series.

The clock determining part 620 may determine a normal mode and an abnormal mode based on the number of the peak signals.

The clock determining part 620 may include a peak detecting part 624 detecting the peak signal, a mode determining signal generating part 626 generating a mode determining signal in response to the peak signals and a comparing part 628 comparing the mode determining signal and a mode reference voltage to generate a mode signal.

The peak detecting part 624 may include an operation amplifier OA1 including a first input terminal connected to the input capacitor C1, C2 and C3, a second input terminal connected to a first power source P1 and an output terminal.

The peak detecting part 624 may amplify the peak signals corresponding to the rising edges of the clock signals to generate second peak signals. The peak signals may be applied to the first input terminal of the operation amplifier OA1. The second peak signals may be outputted from a first node N1.

The second peak signals at the first node N1 may be applied to the mode determining signal generating part 626 through a first buffer B1.

The mode determining signal generating part 626 generates the mode determining signal in response to the second peak signals. In an exemplary embodiment, the mode determining signal generating part 626 may generate the mode determining signal having a sawtooth wave in response to the second peak signals, for example.

In an exemplary embodiment, the mode determining signal generating part 626 may include a second power source P2, a fifth resistor R5 including a first end connected to the second power source P2 and a second end connected to an output electrode of a first transistor T1, a second capacitor CC2 connected to the second end of the fifth resistor R5 and the first transistor T1 including a control electrode to which the second peak signals are applied, an input electrode connected to the ground and the output electrode connected to the second end of the fifth resistor R5, for example.

In an exemplary embodiment, the first transistor T1 may be a signal generating transistor, the fifth resistor R5 may be a signal generating resistor and the second capacitor CC2 may be a signal generating capacitor, for example. According to a time constant of an RC circuit formed by the fifth resistor R5 and the second capacitor CC2, the wave form of the mode determining signal outputted to the output electrode of the first transistor T1 may be determined.

The comparing part 628 compares the mode determining signal VSW and the mode reference voltage VR to generate the mode signal VCP. The mode signal VCP may be one of a normal mode signal representing a normal operation of the power voltage generator 600B and an abnormal mode signal representing an abnormal operation of the power voltage generator 600B.

In an exemplary embodiment, when a level of the mode signal VCP is a high level, the power voltage generator 600B is in the normal operation, for example. In an exemplary embodiment, when a level of the mode signal VCP is a low level, the power voltage generator 600B is in the abnormal operation, for example.

In an exemplary embodiment, the comparing part 628 may include a third power source P3, an comparator OA2 including a first input terminal connected to the third power source P3, a second input terminal connected to the output electrode of the signal generating transistor T1 and an output terminal connected to an output node N3 of the clock determining part 620A, for example.

The comparing part 628 may further include a third capacitor CC3 connected between the output node N3 of the clock determining part 620A and the ground.

The power voltage generator 600B may further include a signal converting part BU disposed between the input pad IP1, IP2 and IP3 and the output pad OP1, OP2 and OP3.

The power voltage generator 600B may further include a plurality of switches SW1, SW2 and SW3 disposed between the input pads IP1, IP2 and IP3 and the signal converting part BU.

When the comparing part 628 determines that the power voltage generator 600B is in the abnormal mode, the switches SW1, SW2 and SW3 are turned off so that the output of the clock signals CKV1, CKV2 and CKV3 of the power voltage generator 600B is blocked.

When the comparing part 628 determines that the power voltage generator 600B is in the normal mode, the switches SW1, SW2 and SW3 are turned on so that the clock signals CKV1, CKV2 and CKV3 are outputted to the gate driver 300.

In the illustrated exemplary embodiment, the power voltage generator 600B further includes the shutdown control part 640. The shutdown control part 640 receives the output signal VCP of the clock determining part 620 and generates a switching control signal CS to control the switches SW1, SW2 and SW3.

The shutdown control part 640 receives the output signal VCP of the clock determining part 620 and generates a switching control signal CS to control the switches SW1, SW2 and SW3 so that the switches SW1, SW2 and SW3 may be stably controlled.

The shutdown control part 640 includes a first resistor RA1 including a first end connected to a first node NA1 and a second end connected to a ground, a first diode DA1 including a first electrode connected to the first end of the first resistor RA1 and a second electrode connected to a second node NA2, a second resistor RA2 including a first end connected to a power source and a second end connected to the second node NA2, a third resistor RA3 including a first end connected to the second node NA2 and a second end connected to the ground, a first transistor TA1 including a control electrode connected to the second node NA2, an input electrode connected to the ground and an output electrode connected to a third node NA3, a fourth resistor RA4 including a first end connected to the power source and a second end connected to the third node NA3, a fifth resistor RA5 including a first end connected to the third node NA3 and a second end connected to a fourth node NA4, a first capacitor CA1 including a first end connected to the fourth node NA4 and a second end connected to the ground, a shutdown operation amplifier OPA1 including a first input terminal connected to the fourth node NA4, a second input terminal to which a shutdown reference voltage VRR is applied and an output terminal, a sixth resistor RA6 including a first end connected to the second input terminal of the shutdown operation amplifier OPA1 and a second end connected to the ground and a seventh resistor RA7 including a first end connected to the output terminal of the shutdown operation amplifier OPA1 and a second end connected to the second input terminal of the shutdown operation amplifier OPA1.

In the illustrated exemplary embodiment, the input diode DI1, DI2 and DI3 and the input capacitor C1, C2 and C3 of the input part 610 of the power voltage generator 600B may be formed on the main PCB 700. The elements (e.g. the clock determining part 620, the shutdown control part 640, the switches SW1, SW2 and SW3 and the signal converting part BU) of the power voltage generator 600B except for the input part 610 may be formed as a single chip, for example.

According to the illustrated exemplary embodiment, the peaks of the rising edges of the clock signals CKV1, CKV2 and CKV3 are detected, the abnormal operation of the display apparatus is determined according to the number of the peaks of the rising edges, and the output of the clock signals CKV1, CKV2 and CKV3 may be stopped. Thus, the clock signals CKV1, CKV2 and CKV3 may be efficiently monitored and the gate driver 300 may be protected. Therefore, the reliability of the display apparatus may be improved.

Figure 12:
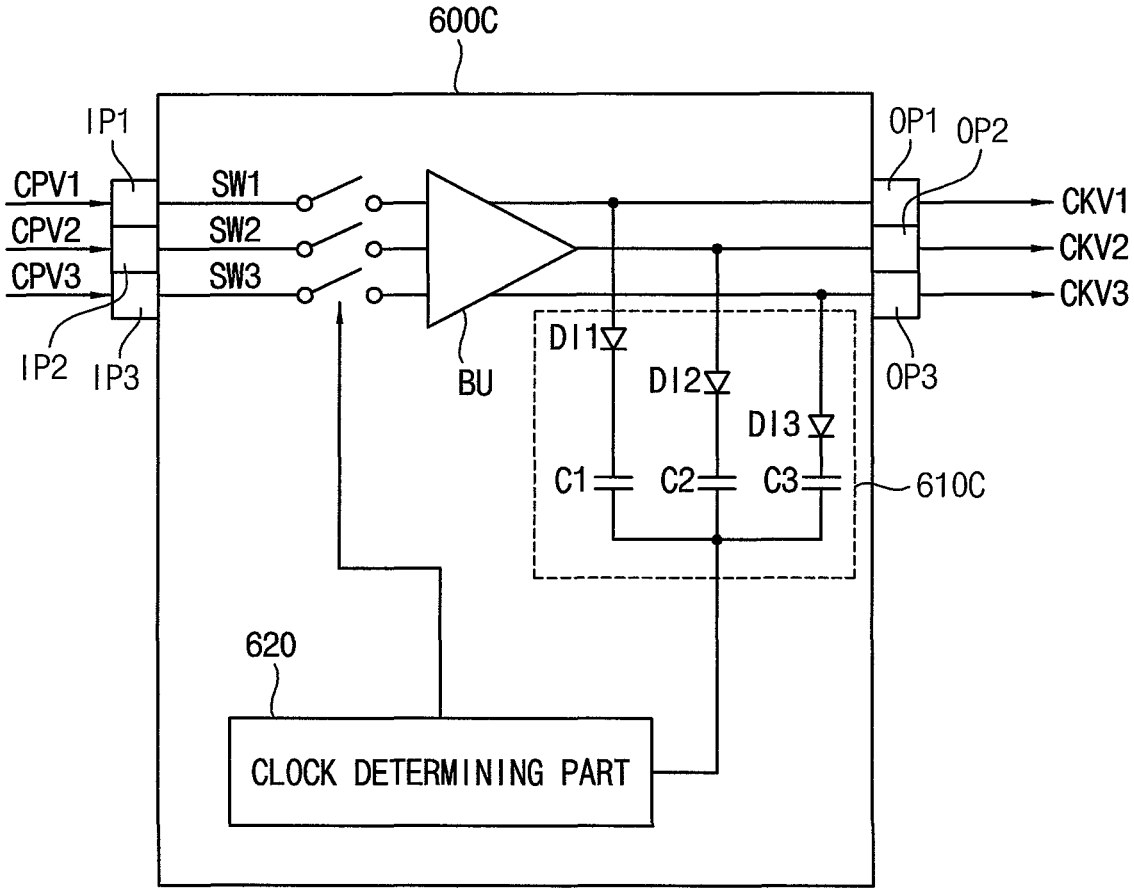
FIG. 12 is a circuit diagram illustrating an exemplary embodiment of a power voltage generator according to the invention.

FIG. 12 is a circuit diagram illustrating a power voltage generator 600C according to an exemplary embodiment of the invention.

The display apparatus according to the illustrated exemplary embodiment is substantially the same as the display apparatus of the previous exemplary embodiment explained referring to FIGS. 1 to 6 except for the circuit structure of the power voltage generator. Thus, the same reference numerals will be used to refer to the same or like parts as those described in the previous exemplary embodiment of FIGS. 1 to 6 and any repetitive explanation concerning the above elements will be omitted.

Referring to FIGS. 1, 2, 4, 5 and 12, the display apparatus includes a display panel 100 and a display panel driver. The display panel driver includes a timing controller 200, a gate driver 300, a gamma reference voltage generator 400, a data driver 500 and a power voltage generator 600C.

The timing controller 200 generates the first control signal CONT1 for controlling an operation of the gate driver 300 based on the input control signal CONT, and outputs the first control signal CONT1 to the gate driver 300. In an exemplary embodiment, the first control signal CONT1 may include a vertical start signal, for example.

The timing controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may generate an initial clock signal CPV and outputs the initial clock signal CPV to the power voltage generator 600C.

The gate driver 300 generates gate signals driving the gate lines GL in response to the first control signal CONT1 received from the timing controller 200. The gate driver 300 outputs the gate signals to the gate lines GL. In an exemplary embodiment, the gate driver 300 may sequentially output the gate signals to the gate lines GL, for example.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600C may generate a signal and a DC voltage for driving the display apparatus.

In an exemplary embodiment, the power voltage generator 600C may generate a common voltage of the display panel 100, for example. The power voltage generator 600C may generate a power voltage of the gate driver 300. The power voltage generator 600C may generate a power voltage of the gamma reference voltage generator 400. The power voltage generator 600C may generate a power voltage of the data driver 500.

The power voltage generator 600C generates a clock signal CKV of the gate driver 300 based on the initial clock signal CPV. The power voltage generator 600C outputs the clock signal CKV to the gate driver 300.

The power voltage generator 600C includes an input part 610C, the clock determining part 620 and a plurality of switches SW1, SW2 and SW3.

The power voltage generator 600C receives a plurality of the initial clock signals CPV1, CPV2 and CPV3 from the timing controller 200. The power voltage generator 600C generates the clock signals CKV1, CKV2 and CKV3 based on the initial clock signals CPV1, CPV2 and CPV3.

The initial clock signals CPV1, CPV2 and CPV3 may be respectively inputted in the power voltage generator 600C through input pads IP1, IP2 and IP3.

The power voltage generator 600C outputs the clock signals CKV1, CKV2 and CKV3 to the gate driver 300.

The clock signals CKV1, CKV2 and CKV3 may be respectively outputted to the gate driver 300 through output pads OP1, OP2 and OP3.

The clock signals CKV1, CKV2 and CKV3 outputted to the gate driver 300 are applied to the input part 610C of the power voltage generator 600C.

The input part 610C receives the plural clock signals CKV1, CKV2 and CKV3 and generates peak signals corresponding to rising edges of the clock signals CKV1, CKV2 and CKV3.

The input part 610C may include an input diode DI1, DI2 and DI3 and an input capacitor C1, C2 and C3 connected to the input diode DI1, DI2 and DI3 in series.

The clock determining part 620 may determine a normal mode and an abnormal mode based on the number of the peak signals.

The clock determining part 620 may include a peak detecting part 624 detecting the peak signal, a mode determining signal generating part 626 generating a mode determining signal in response to the peak signals and a comparing part 628 comparing the mode determining signal and a mode reference voltage to generate a mode signal.

The peak detecting part 624 may include an operation amplifier OA1 including a first input terminal connected to the input capacitor C1, C2 and C3, a second input terminal connected to a first power source P1 and an output terminal.

The peak detecting part 624 may amplify the peak signals corresponding to the rising edges of the clock signals to generate second peak signals. The peak signals may be applied to the first input terminal of the operation amplifier OA1. The second peak signals may be outputted from a first node N1.

The second peak signals at the first node N1 may be applied to the mode determining signal generating part 626 through a first buffer B1.

The mode determining signal generating part 626 generates the mode determining signal in response to the second peak signals. In an exemplary embodiment, the mode determining signal generating part 626 may generate the mode determining signal having a sawtooth wave in response to the second peak signals, for example.

In an exemplary embodiment, the mode determining signal generating part 626 may include a second power source P2, a fifth resistor R5 including a first end connected to the second power source P2 and a second end connected to an output electrode of a first transistor T1, a second capacitor CC2 connected to the second end of the fifth resistor R5 and the first transistor T1 including a control electrode to which the second peak signals are applied, an input electrode connected to the ground and the output electrode connected to the second end of the fifth resistor R5, for example.

In an exemplary embodiment, the first transistor T1 may be a signal generating transistor, the fifth resistor R5 may be a signal generating resistor and the second capacitor CC2 may be a signal generating capacitor, for example. According to a time constant of an RC circuit formed by the fifth resistor R5 and the second capacitor CC2, the wave form of the mode determining signal outputted to the output electrode of the first transistor T1 may be determined.

The comparing part 628 compares the mode determining signal VSW and the mode reference voltage VR to generate the mode signal VCP. The mode signal VCP may be one of a normal mode signal representing a normal operation of the power voltage generator 600C and an abnormal mode signal representing an abnormal operation of the power voltage generator 600C.

In an exemplary embodiment, when a level of the mode signal VCP is a high level, the power voltage generator 600C is in the normal operation, for example. In an exemplary embodiment, when a level of the mode signal VCP is a low level, the power voltage generator 600C is in the abnormal operation, for example.

In an exemplary embodiment, the comparing part 628 may include a third power source P3, an comparator OA2 including a first input terminal connected to the third power source P3, a second input terminal connected to the output electrode of the signal generating transistor T1 and an output terminal connected to an output node N3 of the clock determining part 620A, for example.

The comparing part 628 may further include a third capacitor CC3 connected between the output node N3 of the clock determining part 620A and the ground.

The power voltage generator 600C may further include a signal converting part BU disposed between the input pad IP1, IP2 and IP3 and the output pad OP1, OP2 and OP3.

The power voltage generator 600C may further include a plurality of switches SW1, SW2 and SW3 disposed between the input pads IP1, IP2 and IP3 and the signal converting part BU.

When the comparing part 628 determines that the power voltage generator 600C is in the abnormal mode, the switches SW1, SW2 and SW3 are turned off so that the output of the clock signals CKV1, CKV2 and CKV3 of the power voltage generator 600C is blocked.

When the comparing part 628 determines that the power voltage generator 600C is in the normal mode, the switches SW1, SW2 and SW3 are turned on so that the clock signals CKV1, CKV2 and CKV3 are outputted to the gate driver 300.

In the illustrated exemplary embodiment, the input diode DI1, DI2 and DI3 and the input capacitor C1, C2 and C3 of the input part 610C of the power voltage generator 600C, the clock determining part 620, the switches SW1, SW2 and SW3 and the signal converting part BU may be formed as a single chip, for example.

The circuit of the input part 610C including the input diode DI1, DI2 and DI3 and the input capacitor C1, C2 and C3 is formed in the chip so that the structure of the display driver and the structure of the wirings may be simplified.

According to the illustrated exemplary embodiment, the peaks of the rising edges of the clock signals CKV1, CKV2 and CKV3 are detected, the abnormal operation of the display apparatus is determined according to the number of the peaks of the rising edges, and the output of the clock signals CKV1, CKV2 and CKV3 may be stopped. Thus, the clock signals CKV1, CKV2 and CKV3 may be efficiently monitored and the gate driver 300 may be protected. Therefore, the reliability of the display apparatus may be improved.

According to the exemplary embodiments of the power voltage generating circuit and the display apparatus, the plurality of the clock signals is accurately monitored so that the gate driver may be protected. Thus, the reliance of the display panel may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A power voltage generating circuit comprising:

an input part which receives a plurality of clock signals and generates a plurality of peak signals corresponding to rising edges of the plurality of clock signals;

a clock determining part which determines a normal mode and an abnormal mode based on a number of the plurality of peak signals; and a plurality of switches which blocks outputs of the plurality of clock signals in the abnormal mode.

2. The power voltage generating circuit of claim 1, wherein the input part comprises:

an input diode which receives a clock signal of the plurality of clock signals; and an input capacitor connected to the input diode in series.

3. The power voltage generating circuit of claim 2, wherein the clock determining part comprises:

a peak detecting part which detects the plurality of peak signals;

a mode determining signal generating part which generates a mode determining signal in response to the plurality of peak signals; and a comparing part which compares the mode determining signal and a mode reference voltage to generate a mode signal.

4. The power voltage generating circuit of claim 3, wherein the peak detecting part comprises an operation amplifier including a first input terminal connected to the input capacitor, a second input terminal connected to a first power source and an output terminal, and wherein the peak detecting part amplifies the plurality of peak signals to generate a plurality of second peak signals.

5. The power voltage generating circuit of claim 4, wherein the mode determining signal generating part which generates the mode determining signal having a sawtooth wave in response to the plurality of second peak signals.

6. The power voltage generating circuit of claim 4, wherein the mode determining signal generating part comprises:

a second power source;

a signal generating resistor including a first end connected to the second power source and a second end connected to an output electrode of a signal generating transistor;

a signal generating capacitor connected to the second end of the signal generating resistor; and the signal generating transistor including a control electrode to which the plurality of second peak signals are applied, an input electrode connected to a ground and the output electrode connected to the second end of the signal generating resistor.

7. The power voltage generating circuit of claim 6, wherein the mode determining signal generating part further comprises a second signal generating resistor including a first end connected to the signal generating transistor and a second end connected to the ground.

8. The power voltage generating circuit of claim 6, wherein the comparing part comprises:

a third power source; and a comparator including a first input terminal connected to the third power source, a second input terminal connected to the output electrode of the signal generating transistor and an output electrode connected to an output node of the clock determining part.

9. The power voltage generating circuit of claim 1, further comprising a shutdown control part which receives an output signal of the clock determining part and generates a switching control signal to control the plurality of switches.

10. The power voltage generating circuit of claim 9, wherein the shutdown control part comprises:

a first resistor including a first end connected to a first node and a second end connected to a ground;

a first diode including a first electrode connected to the first end of the first resistor and a second electrode connected to a second node;

a second resistor including a first end connected to a power source and a second end connected to the second node;

a third resistor including a first end connected to the second node and a second end connected to the ground;

a first transistor including a control electrode connected to the second node, an input electrode connected to the ground and an output electrode connected to a third node;

a fourth resistor including a first end connected to the power source and a second end connected to the third node;

a fifth resistor including a first end connected to the third node and a second end connected to a fourth node;

a first capacitor including a first end connected to the fourth node and a second end connected to the ground;

a shutdown operation amplifier including a first input terminal connected to the fourth node, a second input terminal to which a shutdown reference voltage is applied and an output terminal;

a sixth resistor including a first end connected to the second input terminal of the shutdown operation amplifier and a second end connected to the ground; and a seventh resistor including a first end connected to the output terminal of the shutdown operation amplifier and a second end connected to the second input terminal of the shutdown operation amplifier.

11. The power voltage generating circuit of claim 1, wherein the number of the plurality of clock signals is N, wherein the plurality of clock signals has phases different from each other, wherein each of the plurality of clock signals is periodically repeated, wherein distances between the rising edges of the plurality of clock signals are uniform in a first cycle in the normal mode, wherein each of the distances between the rising edges of first to N-th clock signals in the first cycle is substantially the same as the distance between the rising edge of the N-th clock signal in the first cycle and a rising edge of a first clock signal in a second cycle in the normal mode, and wherein N is a natural number equal to or greater than two.

12. The power voltage generating circuit of claim 1, wherein the number of the plurality of clock signals is N, wherein the plurality of clock signals has phases different from each other, wherein each of the plurality of clock signals is periodically repeated, wherein distances between the rising edges of the plurality of clock signals are uniform in a first cycle in the normal mode, wherein each of the distances between the rising edges of first to N-th clock signals in the first cycle is different from the distance between the rising edge of the N-th clock signal in the first cycle and a rising edge of a first clock signal in a second cycle in the normal mode, and wherein N is a natural number equal to or greater than two.

13. A display apparatus comprising:

a display panel which displays an image;

a gate driver which provides a gate signal to the display panel;

a data driver which provides a data voltage to the display panel;

a timing controller which controls driving timing of the gate driver and driving timing of the data driver; and a power voltage generator which provides a plurality of clock signals to the gate driver, and comprises:

an input part which receives the plurality of clock signals and generates a plurality of peak signals corresponding to rising edges of the plurality of clock signals;

a clock determining part which determines a normal mode and an abnormal mode based on a number of the plurality of peak signals; and a plurality of switches which block outputs of the plurality of clock signals in the abnormal mode.

14. The display apparatus of claim 13, wherein the input part comprises:

an input diode which receives a clock signal of the plurality of clock signals; and an input capacitor connected to the input diode in series.

15. The display apparatus of claim 14, wherein the clock determining part comprises:

a peak detecting part which detects the plurality of peak signals;

a mode determining signal generating part which generates a mode determining signal in response to the plurality of peak signals; and a comparing part which compares the mode determining signal and a mode reference voltage to generate a mode signal.

16. The display apparatus of claim 15, wherein the peak detecting part comprises an operation amplifier including a first input terminal connected to the input capacitor, a second input terminal connected to a first power source and an output terminal, and wherein the peak detecting part amplifies the plurality of peak signals to generate a plurality of second peak signals.

17. The display apparatus of claim 16, wherein the mode determining signal generating part comprises:

a second power source;

a signal generating resistor including a first end connected to the second power source and a second end connected to an output electrode of a signal generating transistor;

a signal generating capacitor connected to the second end of the signal generating resistor; and the signal generating transistor including a control electrode to which the plurality of second peak signals are applied, an input electrode connected to a ground and the output electrode connected to the second end of the signal generating resistor.

18. The display apparatus of claim 17, wherein the comparing part comprises:

a third power source; and a comparator including a first input terminal connected to the third power source, a second input terminal connected to the output electrode of the signal generating transistor and an output electrode connected to an output node of the clock determining part.

19. The display apparatus of claim 13, further comprising a printed circuit board on which the power voltage generator and the timing controller are disposed, wherein the input part of the power voltage generator is disposed on the printed circuit board, and wherein the clock determining part and the plurality of switches are formed as a single chip.

20. The display apparatus of claim 13, wherein the input part of the power voltage generator, the clock determining part and the plurality of switches are formed as a single chip.

* * * * *